US012733728B2

(12) United States Patent
Xing et al.

(10) Patent No.: US 12,733,728 B2
(45) Date of Patent: Sep. 15, 2026

(54) AUTOMATIC DETECTION OF HAIR CHARACTERISTICS USING A FORMULATION DISPENSING DEVICE

(71) Applicant: L'Oreal, Paris (FR)

(72) Inventors: Huajing Xing, Parsippany, NJ (US); Ji Heun Lee, New York, NY (US)

(73) Assignee: L'Oreal, Paris (FR)

( * ) Notice: Subject to any disclaimer, the term of this patent is extended or adjusted under 35 U.S.C. 154(b) by 907 days.

(21) Appl. No.: 18/158,321

(22) Filed: Jan. 23, 2023

(65) Prior Publication Data

US 2023/0232965 A1 Jul. 27, 2023

Related U.S. Application Data

(60) Provisional application No. 63/302,443, filed on Jan. 24, 2022.

(30) Foreign Application Priority Data

Apr. 20, 2022 (FR) ..... 2203627

(51) Int. Cl.
*A45D 44/00* (2006.01)
*A45D 19/02* (2006.01)

(52) U.S. Cl.
CPC ..... *A45D 44/005* (2013.01); *A45D 19/026* (2021.01); *A45D 2044/007* (2013.01)

(58) Field of Classification Search
CPC ..... A45D 44/005; A45D 2044/007; A45D 19/026; A61B 5/446; A61B 5/448; B05B 13/041; G06N 20/00
See application file for complete search history.

(56) References Cited

U.S. PATENT DOCUMENTS 8,688,268 B2 * 4/2014 Samain ..... B01F 33/8442 700/239
10,598,230 B2 3/2020 Grez et al.
(Continued)

FOREIGN PATENT DOCUMENTS

JP 2020534953 A 12/2020
JP 2021518244 A 5/2023
(Continued)

OTHER PUBLICATIONS

Annex to Form PCT/ISA/206 Communication Relating to the Results of the Partial International Search mailed Jul. 5, 2023, issued in corresponding International Application No. PCT/US2023/011366, filed Jan. 23, 2023, 12 pages.
(Continued)

*Primary Examiner* — Timothy R Waggoner
(74) *Attorney, Agent, or Firm* — Christensen O'Connor Johnson Kindness PLLC

(57) ABSTRACT

In some embodiments, a formulation delivery device comprising a motor and a formulation dispensing assembly is provided. The formulation dispensing assembly comprises a reciprocating nozzle assembly operated by the motor. The formulation delivery device further comprises circuitry configured to generate signals indicative of application of one or more formulation products dispensed by the formulation dispensing assembly, and circuitry configured to transmit the signals indicative of the application of the formulation products to a usage analysis system. In some embodiments, a computer-implemented method of automatically determining at least one hair characteristic for a subject is provided. A computing system receives signals from a formulation delivery device indicative of application of one or more dispensed formulation products, analyzes the signals to automatically determine the at least one hair characteristic,
(Continued)

and stores the at least one hair characteristic in a usage data store.

17 Claims, 13 Drawing Sheets

(56) References Cited

U.S. PATENT DOCUMENTS

| | | | | |
|---|---|---|---|---|
| 10,694,832 | B2 | 6/2020 | Grez | |
| 11,278,099 | B2 | 3/2022 | Grez et al. | |
| 11,292,284 | B2 | 4/2022 | Busam et al. | |
| 11,311,098 | B2 | 4/2022 | Grez | |
| 11,470,940 | B2 | 10/2022 | Grez et al. | |
| 2017/0251783 | A1 | 9/2017 | Grez | |
| 2019/0098974 | A1* | 4/2019 | Grez | A45D 24/26 |
| 2019/0209077 | A1* | 7/2019 | Charraud | A46B 15/0004 |
| 2020/0221995 | A1 | 7/2020 | Mathiaszyk et al. | |
| 2020/0317500 | A1 | 10/2020 | Belkhir et al. | |
| 2020/0354134 | A1 | 11/2020 | Sherrell et al. | |
| 2021/0085060 | A1* | 3/2021 | Matsui | G06N 5/04 |
| 2021/0127811 | A1* | 5/2021 | Puls | A45D 44/005 |

FOREIGN PATENT DOCUMENTS

| | | | |
|---|---|---|---|
| WO | 2019/067336 | A2 | 4/2019 |
| WO | 2022/182670 | A1 | 9/2022 |

OTHER PUBLICATIONS

Search Report and Written Opinion mailed Nov. 10, 2022, in corresponding French application No. 2203627 (French version), filed Apr. 20, 2022, 6 pages.

Office Action mailed Jun. 30, 2025, in corresponding Japanese application No. 2024-543552, filed Jan. 23, 2023, 8 pages.

International Search Report and Written Opinion mailed Aug. 30, 2023, issued in corresponding International Application No. PCT/US2023/011366, filed Jan. 23, 2023, 17 pages.

Office Action mailed Nov. 13, 2025, in corresponding Korean application No. 10-2024-7019869, filed Jan. 23, 2023, 8 pages.

Office Action mailed Sep. 29, 2025, in corresponding Japanese application No. 2024-543552, filed Jan. 23, 2023, 6 pages.

* cited by examiner

AUTOMATIC DETECTION OF HAIR CHARACTERISTICS USING A FORMULATION DISPENSING DEVICE

CROSS REFERENCES TO RELATED APPLICATIONS

This application claims the benefit of U.S. Provisional Application No. 63/302,443, filed Jan. 24, 2022, and claims priority to French Patent Application No. 2203627, filed Apr. 20, 2022, the entire disclosures of which are hereby incorporated by reference herein for all purposes.

SUMMARY

In some embodiments, a formulation delivery device is provided. The formulation delivery device includes a motor and a formulation dispensing assembly. The formulation dispensing assembly also includes a reciprocating nozzle assembly operated by the motor. The formulation delivery device further includes circuitry configured to generate signals indicative of application of one or more formulation products dispensed by the formulation dispensing assembly, and circuitry configured to transmit the signals indicative of the application of the formulation products to a usage analysis system.

In some embodiments, a computer-implemented method of automatically determining at least one hair characteristic for a subject is provided. A computing system receives signals from a formulation delivery device indicative of application of one or more dispensed formulation products. The computing system analyzes the signals to automatically determine the at least one hair characteristic. The computing system stores the at least one hair characteristic in a usage data store.

In some embodiments, a system for automatically determining at least one hair characteristic for a subject is provided. The system includes circuitry configured to receive signals from a formulation delivery device indicative of application of one or more dispensed formulation products, circuitry configured to analyze the signals to automatically determine the at least one hair characteristic, and circuitry configured to store the at least one hair characteristic in a usage data store.

BRIEF DESCRIPTION OF THE SEVERAL VIEWS OF THE DRAWINGS

The foregoing aspects and many of the attendant advantages of the claimed subject matter will become more readily appreciated by reference to the following detailed description, when taken in conjunction with the accompanying drawings, wherein:

DETAILED DESCRIPTION

Figure 1:
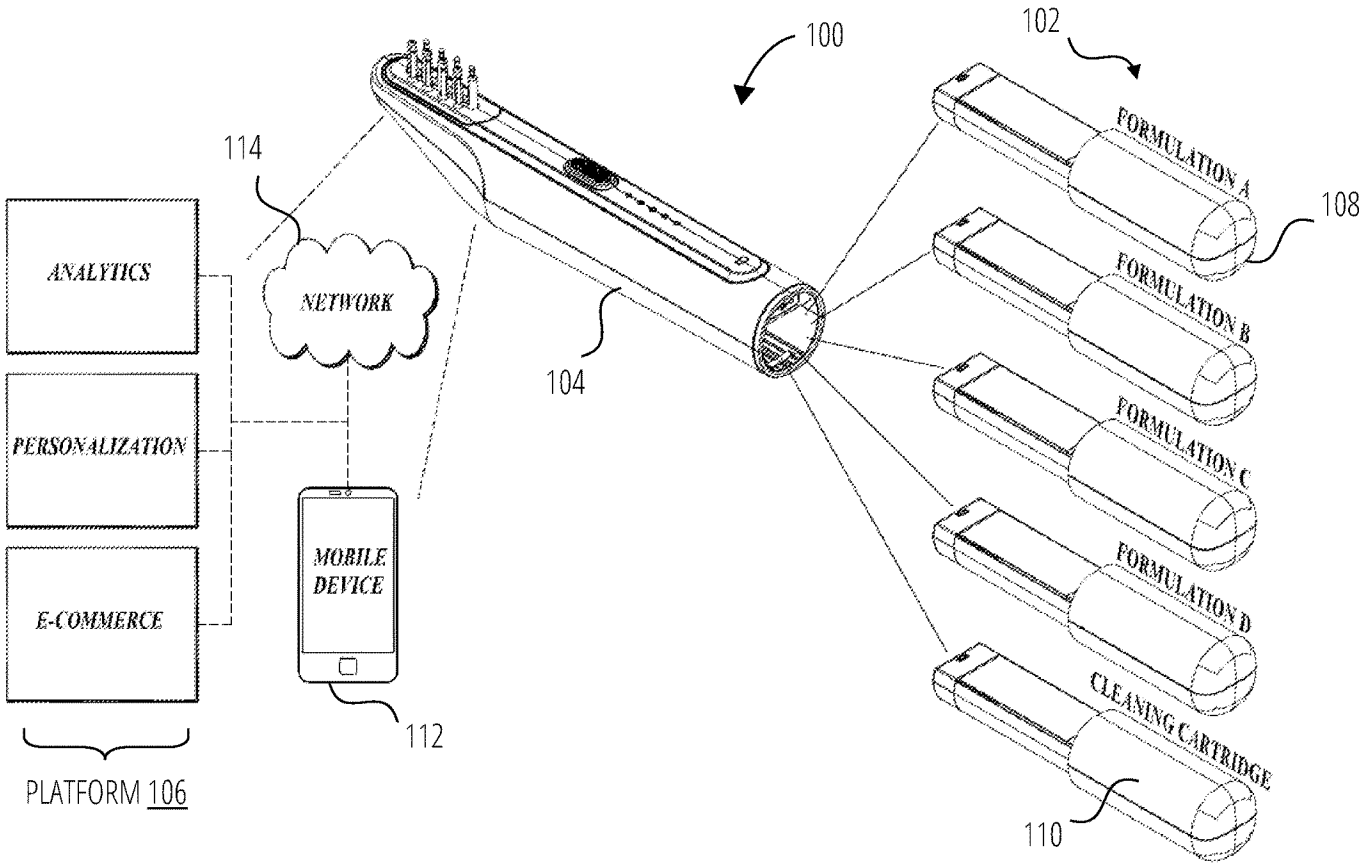
FIG. 1 shows a schematic view of a formulation delivery system, in accordance with a representative embodiment of the present disclosure.

The following description provides representative examples that relate generally to using hair and scalp treatment formulation delivery systems to generate and collect information about hair of subjects, and uses for such information.

Application of a wide variety of treatment formulations to human hair and scalp tissue is a common practice. In some instances, it is beneficial for the treatment formulation to be applied to a targeted portion of the hair or scalp tissue. In one example, applying a treatment formulation to a portion of the hair near the scalp may be desired, for instance, when applying a coloring dye to roots of hair during a color maintenance procedure. In another example, applying a scalp treatment formulation directly to the scalp tissue, while minimizing contact with the hair, may be desired.

Existing systems for the application of hair and scalp treatment formulations have been widely used. In one example, hair coloring kits are generally used to change the appearance of the hair color or to blend gray hairs, among other uses. Existing hair coloring systems have several disadvantages, including difficulty of use, time consumption, uneven coverage, unpredictable results, excessive mess, etc. In one aspect, existing hair coloring systems can be ineffective in blending and coloring the roots of the hair after new segments of hair have grown from the scalp, where the natural hair color differs from the remainder of the dyed hair. The present disclosure is directed toward solving these and other needs.

In some embodiments, hair coloring formulation includes at least one dye and a separate developer, which are mixed in controlled proportions. However, "formulation" is not limited to dye and developer in this disclosure. As used herein, the term "formulation" refers generally to any of the dye, developer, formulation, fluid, or any mixture thereof. In this disclosure, "formulation" includes: permanent hair dye; semi-permanent hair dye; developer; conditioner; hair growth treatment, such as minoxidil manufactured under the trade name ROGAINE®; hair protein treatment; disulfide bond repairing hair treatment; fluid hair treatment; fluid scalp treatment; activator; relaxer, and the like.

As described below, formulation delivery devices have been created that are configured to apply formulation to targeted areas of the hair and scalp tissue. Although any of the above-mentioned formulations are suitably applied using the embodiments described herein, the present disclosure generally refers to hair coloring formulation as one representative example of treatment formulation applied by the systems and devices described below. However, it shall be appreciated that any of the systems, devices, cartridges, and methods may be utilized with any of the above-mentioned formulations.

In some embodiments of the present disclosure, information generated during use of a formulation delivery device to dispense and apply formulation products to hair of a subject is used to automatically determine characteristics of the hair of the subject. In some embodiments, these automatically determined characteristics can then be collected and used for a variety of purposes, including but not limited to providing recommendations for products likely to be useful based on the characteristics of the hair of the subject.

FIG. 1 illustrates one representative formulation delivery system 100 in accordance with the present disclosure. The formulation delivery system 100 includes a number of different features, including a formulation product line 102, a formulation delivery device 104, and an optional platform 106, which together enable a customized user experience.

Formulation product line 102 includes different formulations, each being stored in a same (common) formulation cartridge 108 type that is configured for use with the formulation delivery device 104. Cartridges of the common formulation cartridge type are generally configured for insertion into a cartridge cavity of a reusable handle of the formulation delivery device. For example, in some embodiments, formulation cartridges and cleaning cartridges have a common cross sectional shape and dimensions. Additionally, some embodiments of the common formulation cartridge type have a common number and arrangement of output nozzles.

Thus, the common formulation cartridge 108 type enables a consumer to utilize many different formulations in a single formulation delivery device 104. A representative formulation cartridge 108 type is described below in FIG. 6A—FIG. 6D.

In a representative embodiment, the formulation product line 102 includes a hair coloring formulation and a scalp treatment formulation. In other representative embodiments, the formulation product line 102 comprises at least two, three, four, five, six, seven, or eight of the following different formulations, each of which is stored within the same formulation cartridge 108 type: a permanent hair dye and a developer; a semi-permanent hair dye and a developer; a shampoo; a conditioner; a hair growth treatment such as minoxidil; a hair protein treatment; a disulfide bond repairing hair treatment; an activator; a relaxer; or a fluid scalp treatment. In still further representative embodiments, the formulation product line 102 includes any of the above combinations, in addition to an optional cleaning cartridge 110 of the same formulation cartridge 108 type.

Formulation cartridge 108 type has an elongate shape and dimensions configured for insertion into a handle of the formulation delivery device 104, in particular into a cartridge cavity of the handle. In some embodiments of the formulation delivery system 100, the elongate outer housing has a different construction between formulation cartridges 108 containing formulation and the cleaning cartridge 110, but with common a common shape and dimensions. For example, in some embodiments, formulation cartridges 108 containing formulation have the construction of the partially-recyclable embodiment shown in FIG. 6A—FIG. 6D, while the cleaning cartridge 110 has similar shape and dimensions, but different materials and components.

Another feature of the formulation cartridge 108 type is a plurality of liquid output nozzles, which are sized and positioned at a distal (forward) end of the formulation cartridge 108 in a configuration that fluidically connects with a corresponding plurality of liquid inlets (e.g., first formulation inlets). In some embodiments, the liquid output nozzles are valves of formulation packets disposed in the formulation cartridge 108.

A representative formulation cartridge 108 type, which is configured for insertion into formulation delivery device 104 and for storing a first formulation and a second formulation, is described below in FIG. 6A-FIG. 6D.

Cleaning cartridge 110, which is of the common formulation cartridge 108 type (i.e., has common exterior dimension and a plurality of liquid output nozzles), enables a user to clean the formulation delivery device 104 by executing a cleaning routine that flushes a cleaning liquid (e.g., water) from the cleaning cartridge 110 through the fluid conduits of the formulation delivery device 104, thereby removing residual formulation in the formulation delivery device 104. Advantageously, the cleaning cartridge 110 and cleaning routine enable a significant portion of the formulation delivery device 104 to be reused for different formulations, thereby reducing waste and cost.

Cleaning cartridge 110 includes a refillable cleaning liquid reservoir disposed inside the outer housing, which is fluidically connected to the plurality of output nozzles. Thus, a user can fill the cleaning liquid reservoir with a cleaning liquid such as water, execute a number of cleaning routines on the formulation delivery device 104, and refill the cleaning liquid reservoir.

Formulation delivery device 104 is a connected electromechanical appliance that interacts with the user, with formulation cartridges 108, and optionally with the platform 106 in order to provide a customized and personalized user experience. A representative formulation delivery device and sub-systems thereof are described below with respect to FIG. 4A-FIG. 5B.

Generally, formulation delivery device 104 comprises a reusable handle configured to receive the formulation cartridge 108 type, as well as a formulation dispensing assembly and a controller, both being disposed in the reusable handle. The formulation dispensing assembly comprises at least one fluid conduit fluidically connected to a motorized pump and to a reciprocating nozzle assembly, and is configured to draw formulation or cleaning liquid from the formulation cartridge 108 and to dispense the same through the reciprocating nozzle assembly onto a hair portion, scalp portion, or body portion of a user.

The controller communicates with an encryption chip reader of a cartridge interrogation interface in the reusable handle to read an encryption chip disposed on the formulation cartridge 108, in order to identify and authenticate which formulation product is stored in the formulation cartridge 108 which is inserted into the reusable handle at any given time. In some embodiments, the controller also authenticates when the cleaning cartridge 110 is inserted into the reusable handle. Based upon the authenticated formulation product or cleaning cartridge 110, the controller causes the formulation delivery device 104 to execute a formulation routine that dispenses the authenticated formulation from the formulation cartridge through the formulation dispensing assembly. Based upon the authenticated cleaning cartridge 110, the controller also causes the formulation delivery device 104 to execute a cleaning routine that dispenses the cleaning liquid through the formulation dispensing assembly.

In some embodiments, the platform 106 includes engines that personalize the user experience, provide helpful analytics, and enable e-commerce. In some embodiments, at least some portions of the platform 106 run on a mobile device 112 such as a smartphone, a tablet, or the like, and interact with a user (e.g., an end user or a salon technician) to provide actionable information through a plurality of engines, which are described below with respect to FIG. 3. In some embodiments, the platform 106 communicates with the formulation delivery device 104 and a network 114, such as a mobile network, a cloud-based enterprise network, a local area network, or the like.

Together, the formulation product line 102, formulation delivery device 104, and platform 106 provide a improved, customized, user experience.

Figure 2:
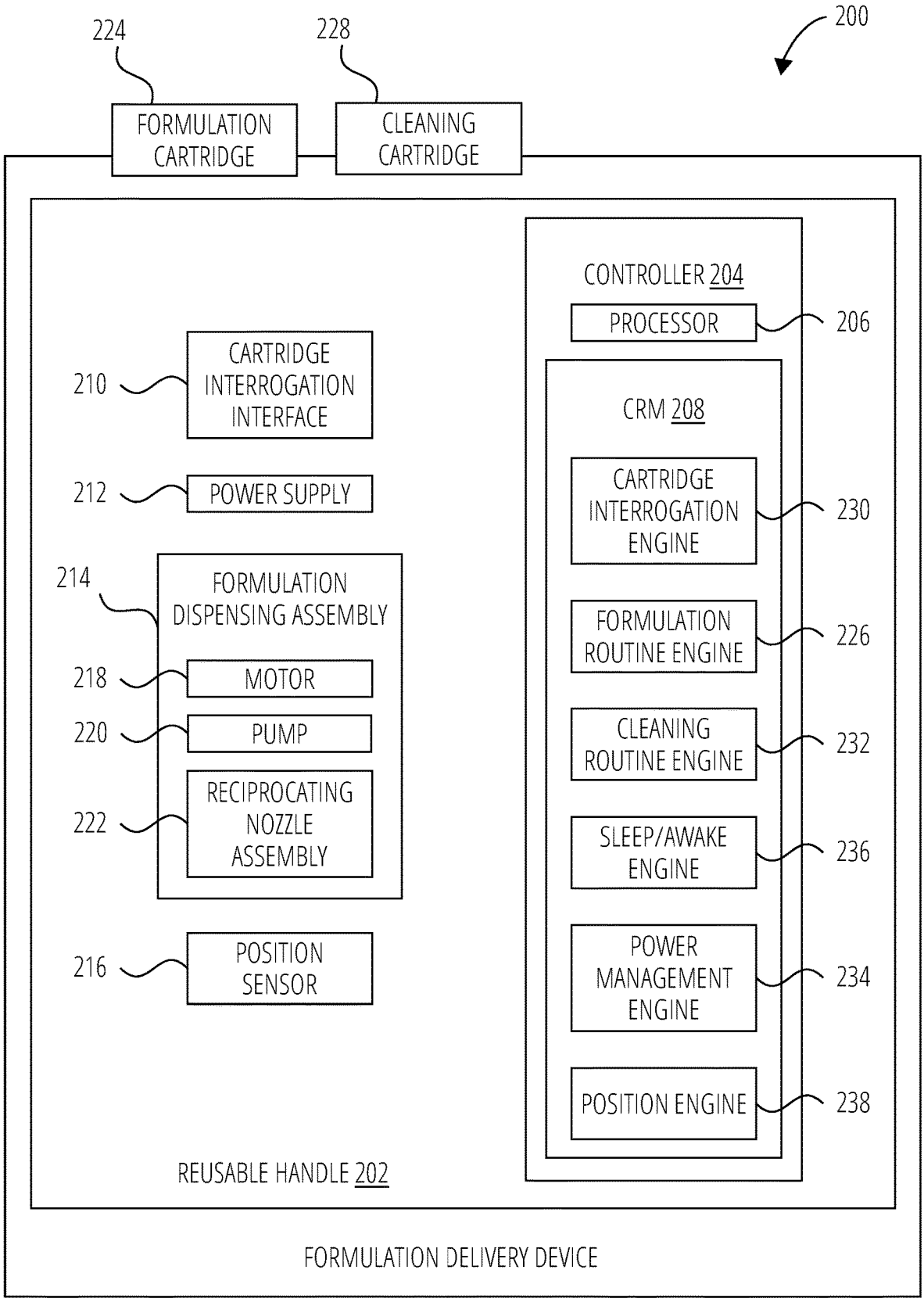
FIG. 2 shows a schematic overview of a formulation delivery device, in accordance with a representative embodiment of the present disclosure.

FIG. 2 shows a schematic overview of a representative formulation delivery device 200, to facilitate understanding of certain representative features thereof. The formulation delivery device 200 shall be understood to have the same features as the formulation delivery device 104 of FIG. 1

Formulation delivery device 200 includes a reusable handle 202 having a hollow elongate portion configured to reversibly receive the common formulation cartridge type (including the cleaning cartridge 110). Reusable handle 202 also houses a number of sub-assemblies, including a controller 204, which includes a processor 206 and computer-readable medium 208 storing a number of engines (described below), cartridge interrogation interface 210, power supply 212, formulation dispensing assembly 214, and a position sensor 216.

Power supply 212 is, in some embodiments, a direct current (DC) power supply, such as a rechargeable battery (e.g., a lithium ion battery) configured to be charged by plugging into a household alternating current outlet. In other embodiments, power supply 212 is an alternating current (AC) power supply, such as common household alternating current that utilizes an electrical cord (not shown) to supply power to the formulation delivery device 200.

Formulation dispensing assembly 214 provides formulation products and/or cleaning liquid from the formulation cartridge 108 to a user's scalp or hair. In an embodiment, formulation dispensing assembly 214 includes: a first fluid conduit fluidically connected to a first formulation inlet (which couples with a first liquid output nozzle of the formulation cartridge 108), a second fluid conduit fluidically connected to a second second formulation inlet (which couples with a second liquid output nozzle of the formulation cartridge 108), a motor 218, a pump 220 driven by the motor 218, and a reciprocating nozzle assembly 222 which is also driven by the motor 218.

Cartridge interrogation interface 210 is an RFID reader, a nearfield reader, or the like, which is positioned in the reusable handle 202 such that when the formulation cartridge 108 is inserted therein, the cartridge interrogation interface 210 reads an encryption chip disposed on the formulation cartridge 224, in order to authenticate the formulation cartridge in connection with the formulation routine engine 226 described below. In some embodiments, the cartridge interrogation interface 210 also reads an identification of a formulation product (or identifications of formulation products) contained in the formulation cartridge 108.

Position sensor 216 includes one or more sensors that, alone or collectively, aid in the determination of the position and orientation of formulation delivery device 200 relative to a user's scalp or hair. In some embodiments, position sensor 216 includes one or accelerometers, touch sensors (e.g., capacitive touch sensors), proximity sensors (e.g., optical proximity sensors), or the like. Signals transmitted from the position sensor 216 are used by the controller 204, and certain engines thereof, in order to improve the accuracy and efficiency of formulation application to a user's hair or scalp. Signals transmitted from the position sensor 216 may also be used by the controller 204 to help determine hair characteristics.

Controller 204 is operatively connected (e.g., electrically connected) to the power supply 212, cartridge interrogation interface 210, formulation dispensing assembly 214, and position sensor 216. Controller 204 includes the processor 206 (e.g., a general processing unit, graphical processing unit, or application specific integrated circuit), computer-readable medium 208 (a tangible machine-readable storage medium), and a plurality of engines implemented as software logic (e.g., executable software code), firmware logic, hardware logic, or various combinations thereof. In some embodiments, controller 204 includes a transceiver that transmits signals from any of the engines discussed below to the mobile device, and receives signals transmitted from the mobile device.

As used herein, "engine" refers to logic embodied in hardware or software instructions, which can be written in one or more programming languages, including but not limited to C, C++, C#, COBOL, JAVA™, PHP, Perl, HTML, CSS, JavaScript, VBScript, ASPX, Go, and Python. An engine may be compiled into executable programs or written in interpreted programming languages. Software engines may be callable from other engines or from themselves. Generally, the engines described herein refer to logical engines that can be merged with other engines, or can be divided into sub-engines. The engines can be implemented by logic stored in any type of computer-readable medium or computer storage device and be stored on and executed by one or more general purpose computers, thus creating a special purpose computer configured to provide the engine or the functionality thereof. The engines can be implemented by logic programmed into an application-specific integrated circuit (ASIC), a field-programmable gate array (FPGA), or another hardware device.

In some embodiments, controller 204 includes a communications interface having circuits configured to enable communication with the formulation delivery system, including formulation cartridge 224 (an encryption chip), cleaning cartridge 228, cartridge interrogation interface 210, a mobile device, and/or other network elements via the internet, cellular network, RF network, Personal Area Network (PAN), Local Area Network, Wide Area Network, or other network. Accordingly, the communications interface may be configured to communicate using wireless protocols (e.g., WIFI®, WIMAX®, BLUETOOTH®, ZIGBEE®, Cellular, 3G, 4G, LTE, Infrared, Nearfield, etc.) and/or wired protocols (Universal Serial Bus, FireWire, or other protocols or standards including but not limited to RS-216, RJ-45, etc., parallel communications bus, etc.). In some embodiments, the communications interface includes circuitry configured to initiate a discovery protocol that allows controller 204 and other network elements (e.g., the formulation cartridge 108) to identify each other and exchange control information (e.g., identity of the formulation stored in the formulation cartridge 108). In an embodiment, the communications interface has circuitry configured to a discovery protocol and to negotiate one or more pre-shared keys.

Computer-readable medium 208 is a tangible machine-readable storage medium that includes a mechanism that stores information in a non-transitory form accessible by a machine (e.g., processor 206, or mobile device 112). For example, a machine-readable storage medium includes recordable/non-recordable media (e.g., read only memory (ROM), random access memory (RAM), magnetic disk storage media, optical storage media, flash memory devices, etc.).

As used herein, "computer-readable medium" refers to a removable or nonremovable device that implements any technology capable of storing information in a volatile or non-volatile manner to be read by a processor of a computing device, including but not limited to: a hard drive; a flash memory; a solid state drive; random-access memory (RAM); read-only memory (ROM); a CD-ROM, a DVD, or other disk storage; a magnetic cassette; a magnetic tape; and a magnetic disk storage.

The engines described below are representative, not limiting. Accordingly, some embodiments of the controller 204 include additional engines, while other embodiments include fewer than all engines.

Cartridge interrogation engine 230 communicates with the cartridge interrogation interface 210 in order to authenticate any formulation cartridge 224 or cleaning cartridge 228 which is inserted into the reusable handle 202, and to obtain information for identifying formulation products contained within the formulation cartridge 224. For example, upon insertion of the formulation cartridge 224 into the reusable handle 202, the cartridge interrogation interface 210 reads a encrypted information from an encryption chip disposed on the formulation cartridge 224. If the cartridge interrogation interface 210 successfully reads the encrypted information from the encryption chip, then the cartridge interrogation engine 230 "unlocks" the formulation delivery device 200, e.g., the formulation routine engine 226. If, however, the cartridge interrogation interface 210 cannot successfully authenticate the formulation cartridge inserted into the reusable handle 202, then it does not unlock the formulation delivery device 200. For example, if the formulation cartridge is a counterfeit cartridge or another cartridge containing inferior formulation, then the cartridge interrogation engine 230 does not unlock the functionality of the formulation delivery device 200. In this way, the cartridge interrogation engine 230 advantageously prevents the user from being harmed or having a poor experience.

Cartridge interrogation engine 230 is configured, in some embodiments, to read additional information from the encryption chip, including one or more of: a formulation identification, a beginning formulation quantity, a formulation expiration date, or a formulation production date. In such embodiments, cartridge interrogation engine 230 transmits the additional information to other engines for subsequent use.

Formulation routine engine 226 stores a plurality of formulation routines for different formulations, and causes the formulation dispensing assembly 214 to execute one or more formulation routines, based upon the formulation cartridge 224 authenticated by the cartridge interrogation engine 230. A formulation routine dispenses the authenticated formulation product from the formulation cartridge 224 through the reciprocating nozzle assembly 222. For example, a formulation routine dispenses one or more formulations from the reciprocating nozzle assembly 222, for a particular dispensation time, at a particular liquid flow rate of the pump, nozzle reciprocating frequency and/or reciprocating amplitude of the reciprocating nozzle assembly 222, and/or other device operating parameter specified by the formulation routine stored in the formulation routine engine 226. In this way, the formulation delivery device 200 adjusts one or more device operating parameters based upon the specific formulation stored in the authenticated formulation cartridge 224 inserted into the formulation delivery device, for more effective hair and scalp treatment.

In some embodiments, formulation routine engine 226 determines, based upon a dispensed time of the authenticated formulation, a dispensed volume of the authenticated formulation from the formulation cartridge through the formulation dispensing assembly. Based upon the dispensed time and/or dispensed volume, the formulation routine engine 226 causes a visual indicator on the reusable handle 202 to signal a remaining formulation quantity. This helps the user anticipate when the formulation cartridge will need to be replaced, and encourages the user to utilize the e-commerce engine of the connected application to conveniently procure additional formulation cartridges.

Cleaning routine engine 232 stores a cleaning routine, and causes the formulation dispensing assembly 214 to execute the cleaning routine after the cleaning cartridge 228 (which has a reservoir filled with a cleaning liquid) is inserted into the reusable handle 202 and authenticated by the cartridge interrogation engine 230. The cleaning routine dispenses the cleaning liquid from the authenticated cleaning cartridge 228 through the reciprocating nozzle assembly 222 (e.g., for a predetermined time and at a predetermined flow rate), in order to evacuate any residual formulation within the formulation dispensing assembly 214. The cleaning routine is useful, for example, after one formulation has been utilized in the formulation delivery device 200, but before a second, different formulation is utilized. In some embodiments, the cleaning routine operates the pump 220 at a higher flow rate than one or more (or all) formulation routines stored by the formulation routine engine 226, in order to clear all residual formulation.

According to a method of the present disclosure, a method of cleaning any of the formulation delivery devices includes inserting the cleaning cartridge at least partially filled with the cleaning liquid into the reusable handle of the formulation delivery device, and executing the cleaning routine until the cleaning liquid dispensed through the formulation dispensing assembly runs clear.

Power management engine 234 provides power from the power supply 212 to one or more of the controller 204, cartridge interrogation interface 210, formulation dispensing assembly 214, or the position sensor 216. Additionally, power management engine 234 conserves available power resources (e.g., conserves battery life) by toggling the formulation delivery device 104 in between a sleep state (a passive state) and an awake state (an active state). In some embodiments, power management engine 234 is configured to measure an amount of power consumed by the motor 218 and/or the pump 220 while operating, and to generate signals based on the consumed power that may be usable to derive hair characteristics.

Sleep/awake engine 236 manages whether the formulation delivery device 200 is in an awake state or a sleep state. The formulation delivery device 200 is in a sleep state by default, whereby little to no power is provided from the power supply 212 to the formulation dispensing assembly 214, cartridge interrogation interface 210, and/or controller 204. In the sleep state, the formulation delivery device 200 is incapable of executing a formulation routine or cleaning routine. In the awake state, by comparison, the controller 204, cartridge interrogation interface 210, formulation dispensing assembly 214, and position sensor 216 are sufficiently powered such that the formulation delivery device 104 is able to execute one or more formulation routines or cleaning routines. In some embodiments, the formulation delivery device 104 is "awakened," i.e., brought from the sleep state to the awake state, by: a push of a button disposed on the reusable handle 202, or by insertion of a formulation cartridge 224 or cleaning cartridge 228 into the reusable handle 202. In some embodiments, the formulation delivery device 200 returns to the sleep state after a predetermined inactivity period (e.g., 120 seconds of inactivity).

Position engine 238 utilizes a position signal provided by the position sensor 216 to determine the position of the formulation delivery device 200, which position information is then provided to other engines, including but not limited to the formulation routine engine 226 in order to facilitate execution of a formulation routine, e.g., a calibration routine. In some embodiments, the position engine 238 provides the position signal to a mobile device or a usage analysis system (via the transceiver), e.g., to enable execution of a calibration routine (described below), to enable the platform 106 to display a correct application indication based upon the position signal, to allow the usage analysis system to determine hair characteristics, or for other purposes.

Figure 3:
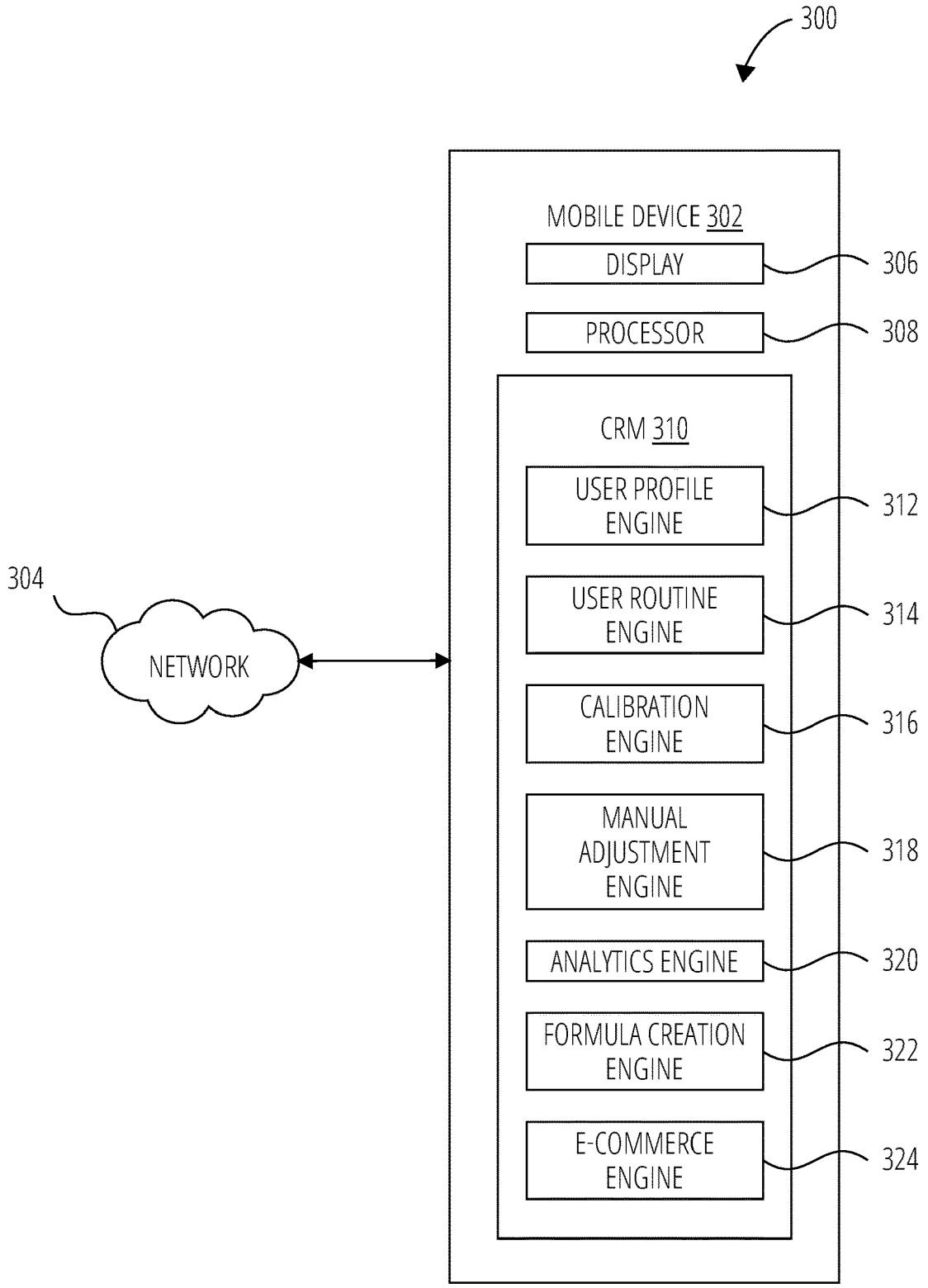
FIG. 3 shows a schematic overview of an application of a formulation delivery system, in accordance with a representative embodiment of the present disclosure.

FIG. 3 shows a schematic overview of a representative platform 300, which shall be understood to have all feature of platform 106 of FIG. 1, and is compatible with all formulation delivery systems and formulation delivery devices of the present disclosure. As noted above, the platform 300 is configured to operate on a device, for example a mobile device such as a smartphone or a tablet. As one representative example, the platform 300 is described in the context of a mobile device 302 connected to a network 304; however, this is not limiting.

Mobile device 302 has a display 306 (e.g., an LED or LCD display), a processor 308, and a computer-readable medium 310 storing a plurality of engines. One or more of the engines described below may present one or more user interfaces on the display 306. The display 306 may be a touch-sensitive display that is configured to receive user inputs thereon. Accordingly, for each engine, the user interface presented on the display 306 is configured both to display information and to receive user inputs.

Platform 300 includes a number of engines which personalize the user experience, including a user profile engine 312 and user routine engine 314. The engines described below are representative, not limiting. Accordingly, some embodiments of the platform 300 include additional engines, while other embodiments include fewer than all engines.

User profile engine 312 builds one or more profiles for users of the formulation delivery device 104. These profiles are provided as inputs to other engines, for example the user routine engine 314 and the e-commerce engine 324. Accordingly, the user profile engine 312 provides one or more user interfaces that prompt a user to provide one or more user profile inputs, including: a hair color, a hair type (e.g., curly, straight), a colored/not colored state, an ethnicity, a hair condition (e.g., damaged), a scalp condition (e.g., itchy), and/or an age. The user profile engine 312 accepts and stores the user profile inputs. In some embodiments, at least some of the user profile inputs may be determined and collected automatically based on information regarding application of dispensed formulation products, as discussed in further detail below.

In some embodiments, user profile engine 312 communicates with user routine engine 314 by providing one or more of the user profile inputs, or an entire user profile, to the user routine engine 314. The user routine engine 314 then utilizes one or more of the user profile inputs to create one or more user-specific routines for the user and/or to select one or more tutorials to present on the display 306.

In some embodiments, user profile engine 312 communicates with formulation delivery device 104. For example, in some embodiments, the user profile engine 312 adjusts at least one device operating parameter of a formulation routine (e.g., flow rate, dispense time, reciprocating amplitude, or reciprocating frequency) generated by the formulation routine engine based upon one or more of the user profile inputs.

User routine engine 314 helps the user effectively utilize the connected formulation delivery device by, in some embodiments, formulating one or more user-specific routines for each user based upon one or more user profile inputs. That is, the user routine engine 314 builds a new formulation routine (rather than selecting a predetermined formulation routine) in order to effectively treat one or more conditions identified by the user profile inputs or to achieve one or more goals identified by the user profile inputs. As one representative example, where user inputs indicate that the user's hair is both colored and damaged, the user routine engine 314 builds a user-specific routine that selects an appropriate hair repair formulation and shampoo formulation for the user's hair color from the formulation product line, and displays the user-specific routine (e.g., as instructions) for utilizing the selected hair repair formulation and shampoo at an interval in determined to improve the health of the user's hair.

In addition, user routine engine 314 displays on the display 306: a) one or more passive tutorials for formulation routines, cleaning routines, and/or calibration routines; and/or one or more active instruction sets that instruct the user, as the user uses the formulation delivery device.

In some embodiments, the user routine engine 314 receives one or more of the user profile inputs, or an entire user profile, from the user profile engine 312, and then displays a passive tutorial (e.g., a pre-recorded instructional video) that is targeted at the user based upon the received user profile inputs or the user profile. As one example, the user routine engine 314 receives a user profile input from the user profile engine 312 indicating that the user has colored hair, and displays a tutorial on the display 306 showing the user how to use the formulation delivery device to color the user's hair.

In some embodiments, the user routine engine 314 receives one or more position signals from the position sensor of the formulation delivery device via the controller. Based upon the received position signals, the user routine engine 314 instructs the user how to use the formulation delivery device as the user uses the device (e.g., instructions to move the formulation delivery device in a particular direction, at a particular speed, in a particular pattern, to a particular spatial boundary). As one example, the user routine engine 314 receives a position signal from the position sensor indicating that the formulation delivery device is positioned at a user's left temple; based upon this received position signal, the user routine engine 314 displays a video instructing the user to apply a scalp treatment formulation by moving the formulation delivery device from the left temple to the right temple while dispensing the scalp treatment formulation.

In some embodiments, user routine engine 314 receives a position signal from the formulation delivery device, and displays a correct application indication based upon the position signal.

Calibration engine 316 helps the user calibrate the formulation delivery device, which in turn increases the efficacy of formulation routines executed by the formulation delivery device. In some embodiments, the calibration engine 316 displays a passive tutorial (e.g., a pre-recorded instructional video) that instructs the user how to complete a calibration routine. In some embodiments, the calibration engine 316 provides one or more active instruction sets that instruct on how to use the complete a calibration routine as the user uses the formulation delivery device, and as the calibration engine 316 receives position signals from the formulation delivery device.

According to one representative calibration routine, the calibration engine 316 instructs the user to position the formulation delivery device at a plurality of calibration locations of a body portion of the user, e.g., in a particular order (e.g., a left temple, then a right temple, then a front hairline, and then a rear hairline). The user then moves the formulation delivery device to each of the calibration locations, indicating with a press of a button on the formulation delivery device or other action when the formulation delivery device is at the specified calibration location, and/or while the user moved the formulation delivery device from one calibration location to another.

Based upon position signals received from the position sensor of the formulation delivery device, the calibration engine 316 and/or the formulation delivery device records the calibration locations. Then, the calibration engine 316 and/or the formulation delivery device adjusts one or more user-specific routines based upon the recorded calibration locations. In some embodiments, this adjustment step includes adjusting a spatial limit and/or a temporal duration of one or more formulation routines stored in the formulation routine engine).

Manual adjustment engine 318 enables a user to manually adjust one or more device operating parameter of the formulation delivery device (e.g., flow rate, dispense time, reciprocating amplitude, or reciprocating frequency), for the advantage of greater control over the formulation delivery device and a more customized user experience. Accordingly, the manual adjustment engine 318 presents a user interface with one or more user-adjustable and virtual sliding scales, switches, editable value fields, and the like, which are configured to receive one or more operating parameter inputs from the user. The manual adjustment engine 318 receives the operating parameter inputs and transmits said operating parameter inputs to the formulation delivery device (e.g., the formulation routine engine), which adjusts the corresponding device operating parameter based upon the corresponding operating parameter input (e.g., to match the operating parameter input).

Analytics engine 320 receives device operating parameters (e.g., from formulation delivery device and computes helpful analytics, which the analytics engine 320 then provides to the user via the user interface and/or to a third party via the network 304. Representative analytics include: a formulation usage pattern, a formulation purchase prediction, and diagnostics of the formulation delivery device. In some embodiments, analytics engine 320 communicates with network 304 (e.g., an analytic platform disposed on one or more cloud-based servers) to retrieve additional information and/or to compute said analytics.

In some embodiments where the formulation delivery device comprises a position sensor that sends a position signal to the controller, and a transceiver that send the position signal to the mobile device. The formulation delivery device transmits the position signal to analytics engine 320, which retrieves a user suggestion from an analytic platform on the network 114 based upon the received position signal, and displays the user suggestion.

Formula creation engine 322 enables a user to create a custom formulation based upon a user's selection of one or more formulation inputs, which correspond to one or more desired outcomes (e.g., desired hair color), one or more formulation inputs (e.g., an indication that the user's hair is damaged), and/or one or more of the user user profile inputs provided to the user profile engine 312. Accordingly, the formula creation engine 322 is configured to receive one or more user profile inputs from the user profile engine 312, and to formulate a custom formulation based upon those inputs.

To facilitate the user's creation of the custom formulation, formula creation engine 322 provides a user interface with one or more user-adjustable and virtual sliding scales, switches, editable value fields, and the like corresponding to each formulation input. In some embodiments, formula creation engine 322 communicates with network 304 (e.g., a database of formulations disposed on one or more cloud-based servers) to retrieve additional information and/or to formulate said custom formulation.

E-commerce engine 324 presents a purchase interface that enables a user to purchase (including on a one-time or subscription basis) products related to the formulation delivery device. In some embodiments, e-commerce engine 324 retrieves one or more custom formulations from formula creation engine 322 (or components thereof) and presents on the purchase interface an option for the user to purchase one or more formulation cartridges 108 containing the custom formulation. In some embodiments, e-commerce engine 324 retrieves one or more user profile inputs and/or user-specific routine inputs from user profile engine 312 and presents on the purchase interface an option for the user to purchase one or more formulation cartridges containing the formulations which target the user profile inputs (for example, where the user inputs indicate damaged hair, a formulation cartridge containing a hair repair formulation). In some embodiments, e-commerce engine 324 presents on the purchase interface an option to purchase the cleaning cartridge 110 or formulation delivery device 104 and/or components thereof. Such purchase interface and purchase options may be based upon a formulation usage pattern and/or a formulation purchase prediction retrieved from the analytics engine 320.

Figure 4A:
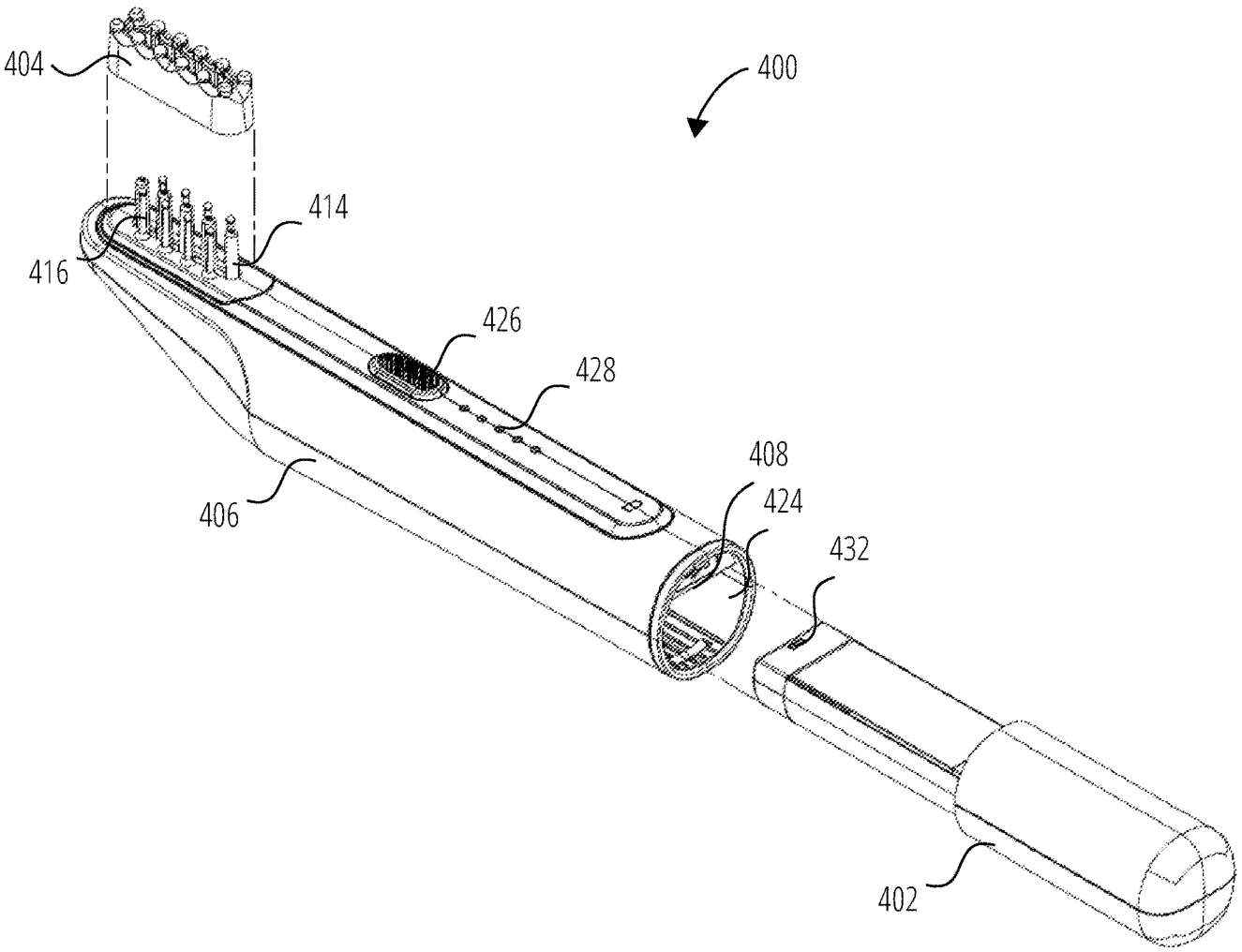
FIG. 4A shows an exploded perspective view of a formulation delivery device, in accordance with a representative embodiment of the present disclosure.
Figure 4B:
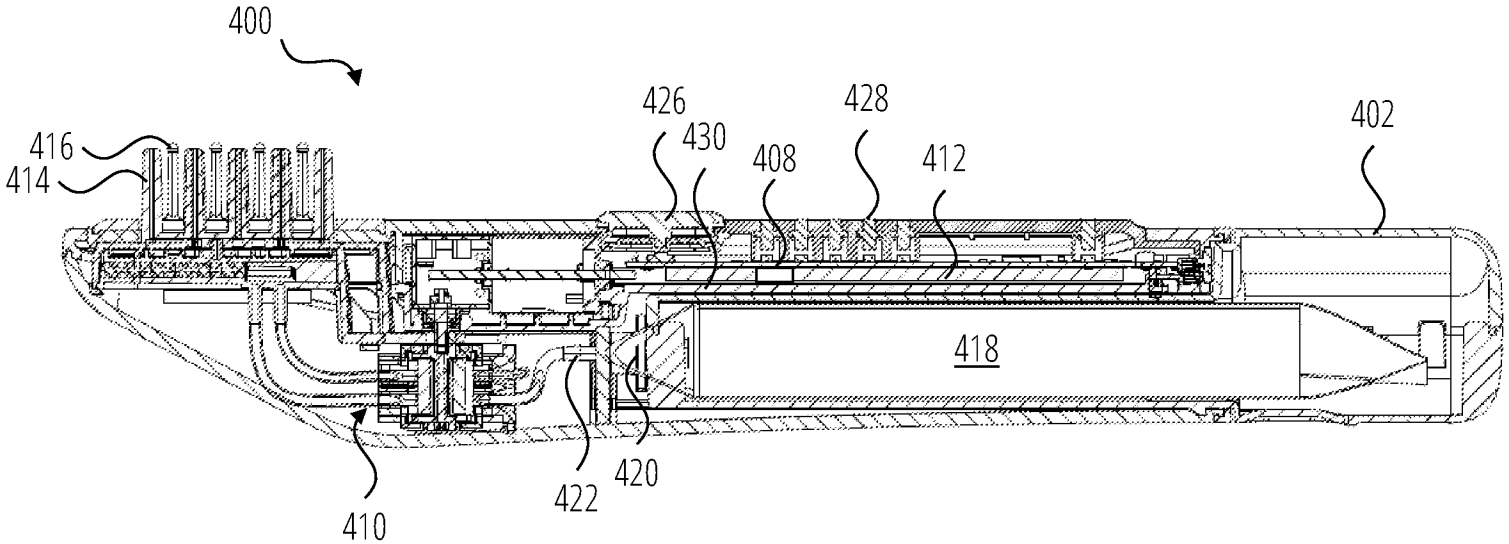
FIG. 4B shows a side section view of the formulation delivery device of FIG. 4A.

FIG. 4A-FIG. 4B show a representative formulation delivery device 400, and components thereof, in accordance with an embodiment of the present disclosure. The formulation delivery device 400 is configured to receive a formulation cartridge 402 type (including a cleaning cartridge of the same type). An embodiment of a formulation cartridge of the formulation cartridge 402 type is described below in detail with respect to FIG. 6A—FIG. 6D; the formulation cartridge 402 shown in FIG. 4A shall be understood to have the same features as described there. Some embodiments of formulation delivery device 400 include the formulation cartridge 402 and/or an optional pull through adaptor 404.

Formulation delivery device 400 includes a reusable handle 406 formed from an ABS plastic or similar rigid polymer or other material, and in some embodiments is an assembly formed from a plurality of shells configured to be joined together with fastening elements such as snaps, screws, or the like. Reusable handle 406 has a hollow, elongate gripping portion with a cartridge cavity therein which is sized and dimensioned to receive the formulation cartridge 402 type. In some embodiments, the cavity includes keying features that facilitate correct insertion of the formulation cartridge 402 type. For example, some embodiments include a cartridge interface 408 disposed in the opening and having a flat docking surface that interfaces with a corresponding docking surface of the formulation cartridge 402 when the latter is correctly inserted into the opening.

Reusable handle 406 houses a formulation dispensing assembly 410 (described below with respect to FIG. 4B-FIG. 5B), in addition to a controller 412. The formulation dispensing assembly 410 and controller 412 have the same features as the formulation dispensing assembly 214 and controller 204 of FIG. 2, respectively. An embodiment of a formulation dispensing assembly is described below in detail with respect to FIG. 5A—FIG. 5B; the formulation dispensing assembly 410 shown in FIG. 4A shall be understood to have the same features as described there.

Formulation dispensing assembly 410 dispenses formulation or cleaning liquid from the formulation cartridge 402, and includes a pump, fluid conduits, a mixing chamber, and a reciprocating nozzle assembly 414 (described below) with nozzles that extend away from the forward end of the reusable handle 406 in between a plurality of optional standoff portions 416. Reciprocating nozzle assembly 414 includes a plurality of annular nozzles that reciprocate back-and-forth along a track of the reusable handle 406 while dispensing formulation onto a user's skin or hair. In some embodiments, the reciprocating nozzle assembly 414 reciprocates at a reciprocating amplitude 7.0-12.0 mm (e.g., 8.0 mm-11.0 mm, or 9.0-10.0 mm) and/or at a reciprocating frequency of 5.0 Hz-10.0 Hz (e.g., 6.0 Hz-9.0 Hz, 6.0 Hz-8.0 Hz), which are adjustable by the formulation routine engine, cleaning routine engine, user routine engine, manual adjustment engine, or other engine.

As shown in FIG. 4B, formulation cartridge 402 has one or more formulation packets 418 disposed therein, each of which has an output nozzle 420 protruding through a distal (forward) end of the formulation cartridge 402 in a configuration that fluidically connects with a corresponding formulation inlet 422 of the formulation dispensing assembly 410 when the formulation cartridge 402 is fully inserted into the cartridge cavity 424.

A button 426 disposed on the reusable handle 406 and electrically connected to the controller 412 activates features of the formulation delivery device 400 described above. In some embodiments, depressing the button 426 activates the features of any of the engines described above in FIG. 2. For example, in some embodiments, pressing button 426 activates a sleep/awake engine stored in controller 412, thereby awakening formulation delivery device 400 from a sleep state to an awake state. In some embodiments, pressing button 426 while a formulation cartridge is inserted into the reusable handle 406 activates a formulation routine engine stored in controller 412, thereby initiating a formulation routine.

In some embodiments, pressing button 426 while a cleaning cartridge is inserted into the reusable handle 406 activates a cleaning routine engine stored in the controller 412, thereby initiating a cleaning routine. Visual indicators 428 (e.g., LEDs) disposed along the reusable handle 406 indicate one or more of a remaining formulation quantity or a remaining battery life, e.g., based upon a dispensed time determined by the formulation routine engine of the controller. Some embodiments include additional buttons and/or a different number of visual indicators 428 with different functionalities, and the illustrated embodiment is not limiting. In some embodiments, visual indicator 428 is a multi-segment LED with each segment corresponding to an equal proportion of the formulation remaining in the formulation cartridge.

Controller 412 comprises logic which when executed by a processor of the controller 412, causes a cartridge interrogation interface 430 disposed in the reusable handle 406 (e.g., an RFID reader) to read an encryption chip 432 on the formulation cartridge 402 in order to authenticate the formulation cartridge 402. The encryption chip 432 stores at least one of an identifier of the formulation cartridge 402, a formulation identification, a beginning formulation quantity, a formulation expiration date, or a formulation production date.

Controller 412 also comprises logic, which when executed, causes the formulation delivery device to execute, based upon authenticating the formulation cartridge 402, a formulation routine that dispenses a mixed formulation (of the first formulation and the second formulation) from the formulation cartridge 402 through the formulation dispensing assembly. For example, the formulation delivery device authenticates the first and second formulations after (or upon) insertion of a formulation cartridge into the reusable handle, and then, in response to pressing a button on the reusable handle, executes a formulation routine which causes formulation dispensing assembly 410 to continuously or continually mix the first and second formulations, and to dispense the same from the reciprocating nozzle assembly at one or more of the following predetermined device operating parameters for as long as the button is depressed: a formulation flow rate, a reciprocating frequency, or a reciprocating amplitude.

In some embodiments, controller 412 also comprises logic, which when executed, causes the formulation delivery device to execute, based upon authenticating a cleaning cartridge inserted into the reusable handles, a cleaning routine that dispenses a cleaning liquid through the formulation dispensing assembly. For example, the formulation delivery device authenticates a cleaning cartridge inserted into the reusable handle, and then, in response to pressing a button on the reusable handle, executes a cleaning routine which causes formulation dispensing assembly 410 to continuously or continually dispense a cleaning liquid (e.g., water) from the reciprocating nozzle assembly at one or more of the following predetermined device operating parameters for as long as the button is depressed: a cleaning liquid flow rate, a reciprocating frequency, or a reciprocating amplitude. In some embodiments, the cleaning liquid flow rate is higher than any formulation flow rate of one or more of the formulation routines stored in the controller 412, for the advantage of effectively flushing residual formulation from the formulation dispensing assembly.

Pull through adaptor 404 attaches to the reusable handle 406 over the reciprocating nozzle assembly 414. In some embodiments, pull through adaptor 404 provides an audible feedback signal upon correct engagement with the reusable handle 406.

Figure 5A:
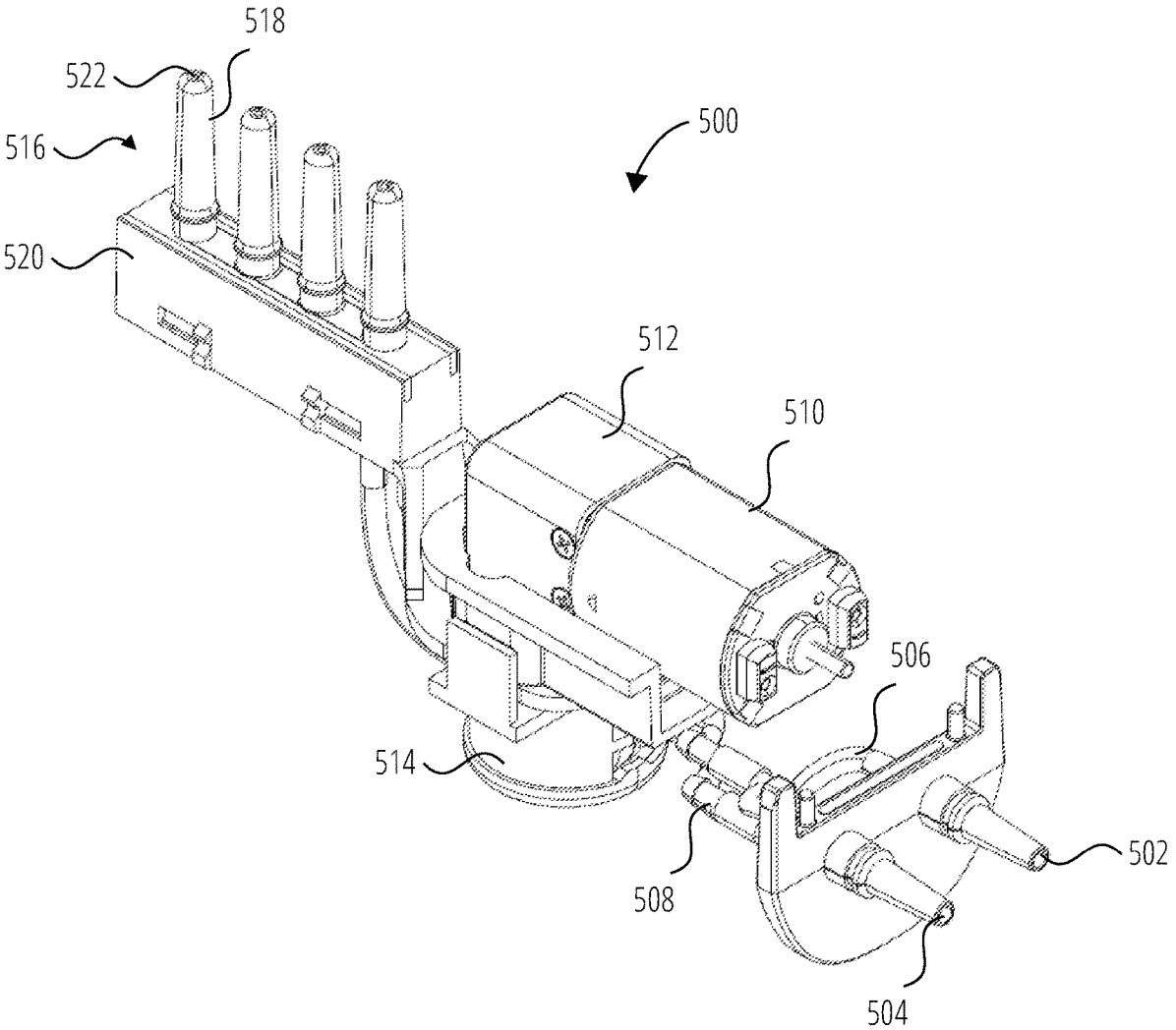
FIG. 5A shows a perspective view of a formulation dispensing assembly, in accordance with a representative embodiment of the present disclosure.
Figure 5B:
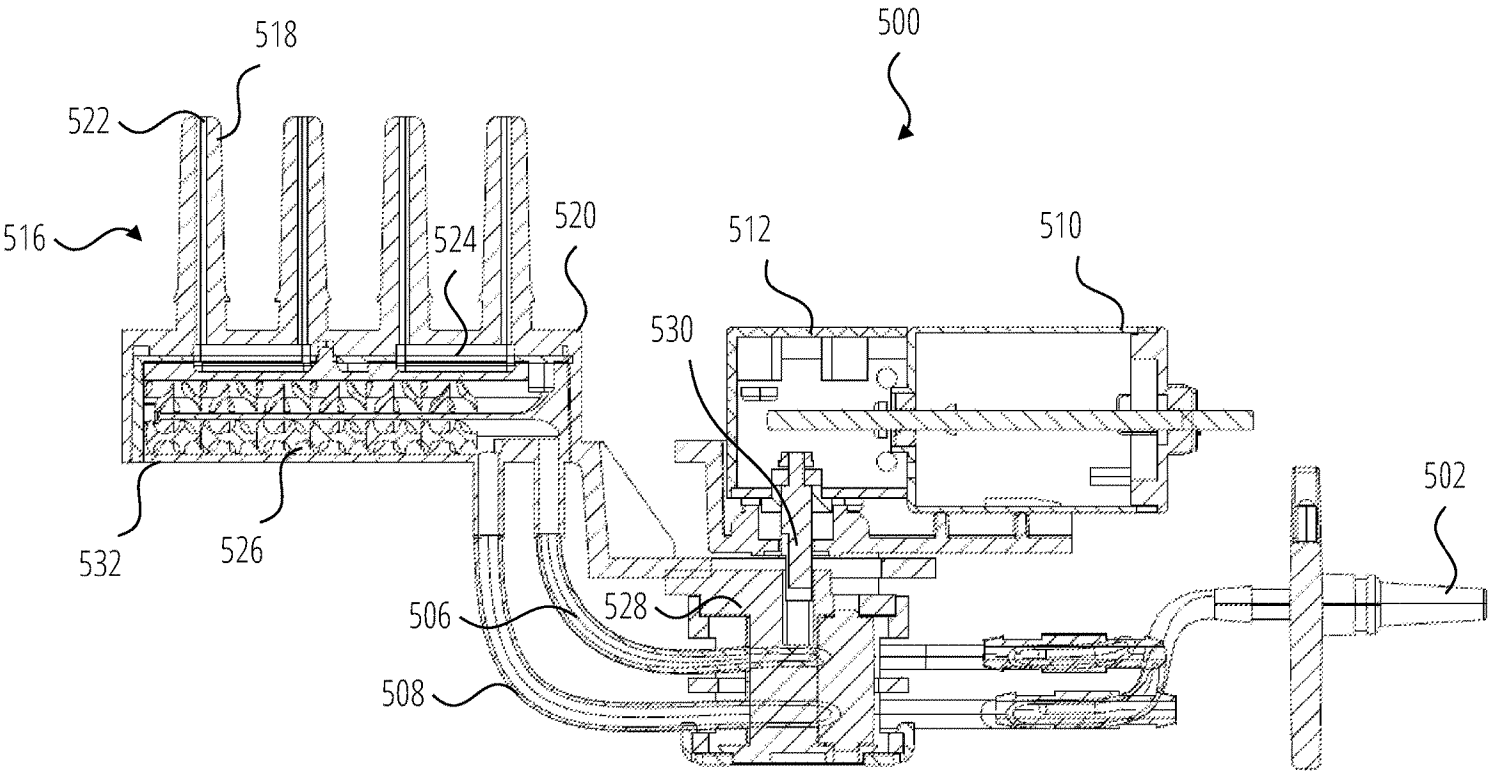
FIG. 5B shows a side section view of the formulation dispensing assembly of FIG. 5A.

FIG. 5A-FIG. 5B show a representative formulation dispensing assembly 500, which is compatible with any of the formulation delivery devices, formulation cartridges, and cleaning cartridges described herein. The primary function of the formulation dispensing assembly 500 is to dispense a mixed formulation of two different formulations from a formulation cartridge onto a user's skin or hair. In some embodiments, the formulation dispensing assembly 500 dispenses the mixed formulation at a flow rate of 20-40 mL/min or 120 mL per four minutes, e.g., 20-35 mL/min, 20-30 mL/min, 20-25 mL/min, 25-35 mL/min, 25-30 mL/min, or 35-40 mL/min.

Formulation dispensing assembly 500 includes a first formulation inlet 502 and a second formulation inlet 504, a first fluid conduit 506 and a second fluid conduit 508 fluidically connected to the first formulation inlet 502 and second formulation inlet 504, respectively. In some embodiments, each of the first formulation inlet 502 and second formulation inlet 504 are formed as protrusions extending rearwardly (i.e., toward the cartridge cavity when disposed in the reusable handle) from the first fluid conduit and the second fluid conduit, respectively, toward a rear end of the reusable handle, the protrusions being configured to project into the formulation cartridge.

The formulation dispensing assembly 500 also includes a motor 510, a gearbox 512 operatively connected to the motor 510, and a pump 514 driven by the motor 510 via the gearbox 512. In some embodiments, pump 514 is a peristaltic pump, which has been discovered to improve formulation dispensing when utilized in combination with the mixing chambers and tapered formulation channels described herein.

A reciprocating nozzle assembly 516 includes a plurality of annular nozzles 518 disposed on a comb 520, that, in use, cycles back-and-forth along a track of the reusable handle 406 while dispensing formulation onto a user's skin or hair, in order to achieve more uniform formulation coverage. Each of the nozzles 518 includes a formulation channel 522 therethrough, each of which is fluidically connected to the first fluid conduit 506 and second fluid conduit 508 via manifold 524. In some embodiments, each formulation channel 522 is tapered, for the advantage of increasing the formulation dispensing velocity and/or for further mixing the two formulations. The tapered formulation channel has proven advantageous when utilized in combination with other features described herein, e.g., wherein the pump 514 is a peristaltic pump and/or wherein the turbulent mixing chamber includes one or more helical mixers 526.

The motor 510 and gearbox 512 drive the reciprocating nozzle assembly 516 in linear reciprocating motion. In an embodiment, the linear reciprocating motion is motivated by an eccentric roller 528 coupled to an output shaft 530 of the gearbox 512, which eccentric roller 528 rotates inside an annular bracket of the comb 520. Driving the pump 514 and reciprocating nozzle assembly 516 with a common motor 510 improves power efficiency, reduces weight and size, thereby improving the form factor of the formulation delivery device. Nevertheless, some embodiments use more than one motor to drive the pump 514 and reciprocating nozzle assembly 516.

Nozzles 518 are fluidically connected to the first fluid conduit 506 and second fluid conduit 508 via a turbulent mixing chamber 532, which mixes a first formulation drawn from the formulation cartridge via the first fluid conduit 506 with a second formulation drawing from the formulation cartridge via the second fluid conduit 508 to create mixed formulation. In particular, the turbulent mixing chamber 532 mixes the two formulations by combining the same in a common chamber under pressure, and flowing the two formulations past one or more mixing elements, which create turbulent flow of the mixed formulation (as distinguished from laminar flow). The proportions of the first formulation to the second formulation vary in different embodiments. For example, is some embodiments, the mixed formulation is a mixture of a first formulation and a second formulation at a ratio of about 0.8:1.0-1.2:1.0, e.g., 0.85, 0.90, 0.95, 1.00, 1.05, 1.10, or 1.15.

In some embodiments, turbulent mixing chamber 532 is disposed between the pump 514 and the reciprocating nozzle assembly 516. In this configuration, the two formulations are mixed just before dispensing, which creates a more uniform formulation consistency and results in better formulation dispensation from the nozzles 518, as compared to mixing the formulations upstream of the pump 514.

In some embodiments, turbulent mixing chamber 532 includes a helical mixer 526 disposed therein. Some embodiments includes a plurality of helical mixers 526 fluidically connected in series along a fluidic pathway within the turbulent mixing chamber 532, for improved mixing. In some embodiments, each helical mixer has an outside diameter between 2.00 mm and 5.00 mm, e.g., between 3.0 mm and 4.00 m, e.g., 3.18 mm. In some embodiments, each helical mixer has a total length of between 20.0 mm and 40.0 mm, e.g., between 25.0 mm and 35.0 mm, e.g., 33.0 mm. In some embodiments, each helical mixer has a length-to-diameter pitch (defined as total length/[outside diameter*#mixing elements]) between 0.75 and 1.25, e.g., between 0.80 and 0.90, e.g., 0.865. The combination of the foregoing specifications has been discovered to produce the best consistency of mixed formulation, particularly when the two formulations are not mixed until downstream of the pump 514, just upstream of the reciprocating nozzle assembly 516, and also when the pump 514 is a peristaltic pump.

In use, the pump 514 draws formulation from the connected formulation cartridge, through the first fluid conduit 506 and second fluid conduit 508, through the turbulent mixing chamber 532, through manifold 524, and through the nozzles 518. In the illustrated embodiment, the first fluid conduit 506 and second fluid conduit 508 are kept fluidically separate until downstream of pump 514, in order to prevent mixing of the two formulations until the turbulent mixing chamber 532. As stated previously, mixing the two formulations just before dispensation (i.e., between the pump 514 and manifold 524), improves the consistency of the mixed formulation.

FIG. 6A-FIG. 6D show a representative formulation cartridge 600 of a formulation cartridge type which is compatible with any of the formulation delivery systems, formulation delivery devices, and formulation product lines described herein. However, the formulation delivery systems, formulation delivery devices, and formulation product lines described herein are not required to use the particular sustainable formulation cartridge 600 shown in FIG. 6A-FIG. 6D.

Formulation cartridge 600 is a sustainable embodiment specifically designed to reduce waste and environmental impact, while delivering a user-friendly experience. To that end, formulation cartridge 600 includes two main components: a handle portion 602 and a disposable refill packet 604 configured to reversibly slide into the handle portion 602. Historically, known cartridges were designed to be entirely disposed after depletion of the formulation stored therein, leading to significant waste and higher consumer cost.

The formulation cartridge 600 is constructed such that the handle portion 602 can be reused indefinitely and only the disposable refill packets 604 need to be discarded or recycled after depletion of the formulation stored therein. Further still, each disposable refill packet 604 is configured to be deconstructed into smaller components, some of which can be recycled, and others disposed of.

Handle portion 602 is sized, dimensioned, and constructed to be repeatedly inserted into the cartridge cavity of the formulation delivery device. Accordingly, handle portion 602 is formed of ABS plastic or similar rigid polymer or other material, and includes a hollow handle portion 602 configured to receive the disposable refill packet 604 therein, and a tray portion 606 that extends away from handle portion 602. Handle portion 602 is a two-piece assembly in the representative embodiment shown (although it may be one-piece in other embodiments), and is sized and dimensioned such that it forms a seamless extension of the formulation delivery device handle when fully inserted into a cartridge cavity thereof. Tray portion 608 projects away from handle portion 602 and has a U-shape configured to support the disposable refill packet 604 (e.g., the front body portion 610). To facilitate secure engagement and easy removal, handle portion 602 includes a cartridge release 612 (e.g., a latch) formed therein, which engages the formulation delivery device upon proper and complete insertion.

Disposable refill packet 604 stores a first formulation packet 614 and a second formulation packet 616, which respectively contain a first formulation and a second formulation. Each of first formulation packet 614 and second formulation packet 616 has a between 40 mL and 70 mL, e.g., 50 mL-60 mL, or 55 mL. In some embodiments, first formulation packet 614 and second formulation packet 616 have different volumes.

The first formulation and second formulation can each be any of the formulations described herein, for example a permanent hair dye; semi-permanent hair dye; developer; conditioner; hair growth treatment, such as minoxidil; hair protein treatment; disulfide bond repairing hair treatment; fluid hair treatment; activator; relaxer; fluid scalp treatment, or the like. In some embodiments, the first formulation and second formulation differ. For example, in some embodiments, the first formulation is a hair dye and the second formulation is a developer. In other embodiments, the first formulation and second formulation are the same (e.g., a conditioner or scalp treatment formulation).

Figure 6A:
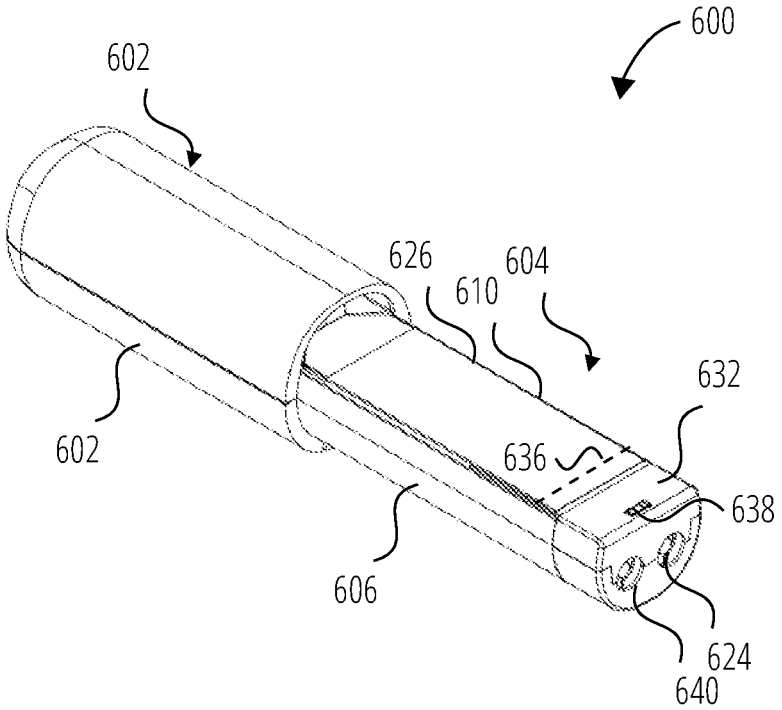
FIG. 6A shows a first perspective view of a formulation cartridge, in accordance with a representative embodiment of the present disclosure.
Figure 6B:
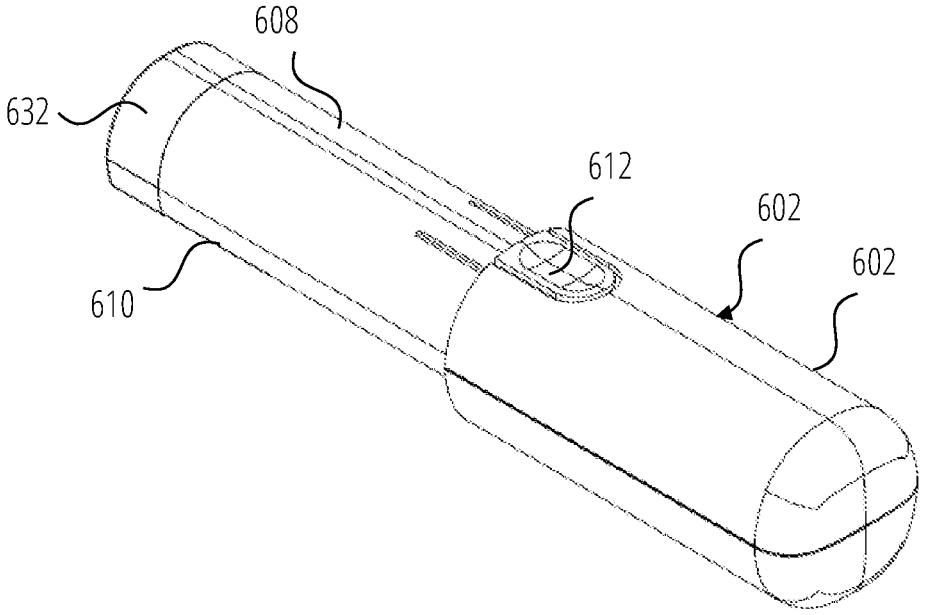
FIG. 6B shows a second perspective view of the formulation cartridge of FIG. 6A.
Figure 6C:
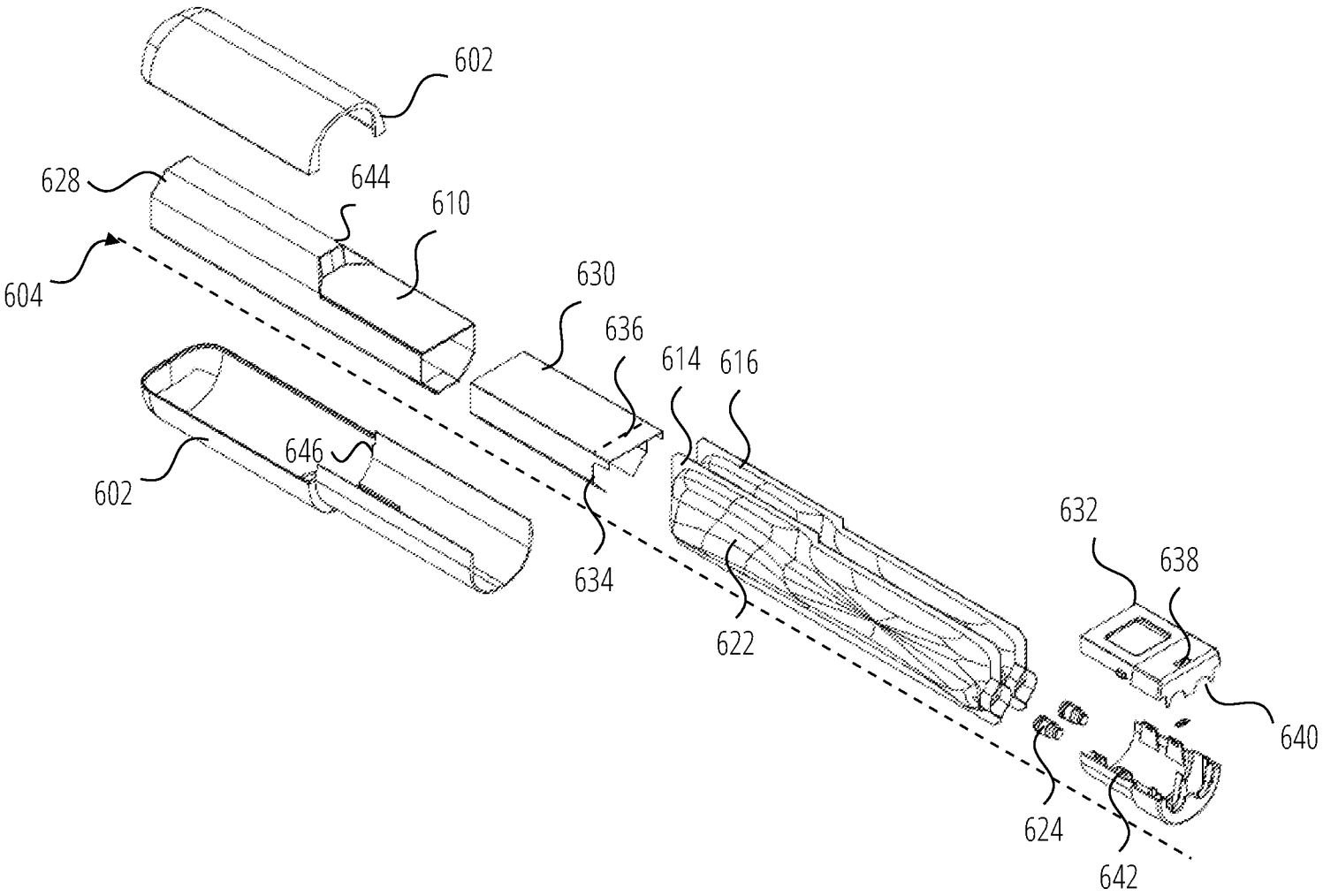
FIG. 6C shows an exploded perspective view of the formulation cartridge of FIG. 6A.
Figure 6D:
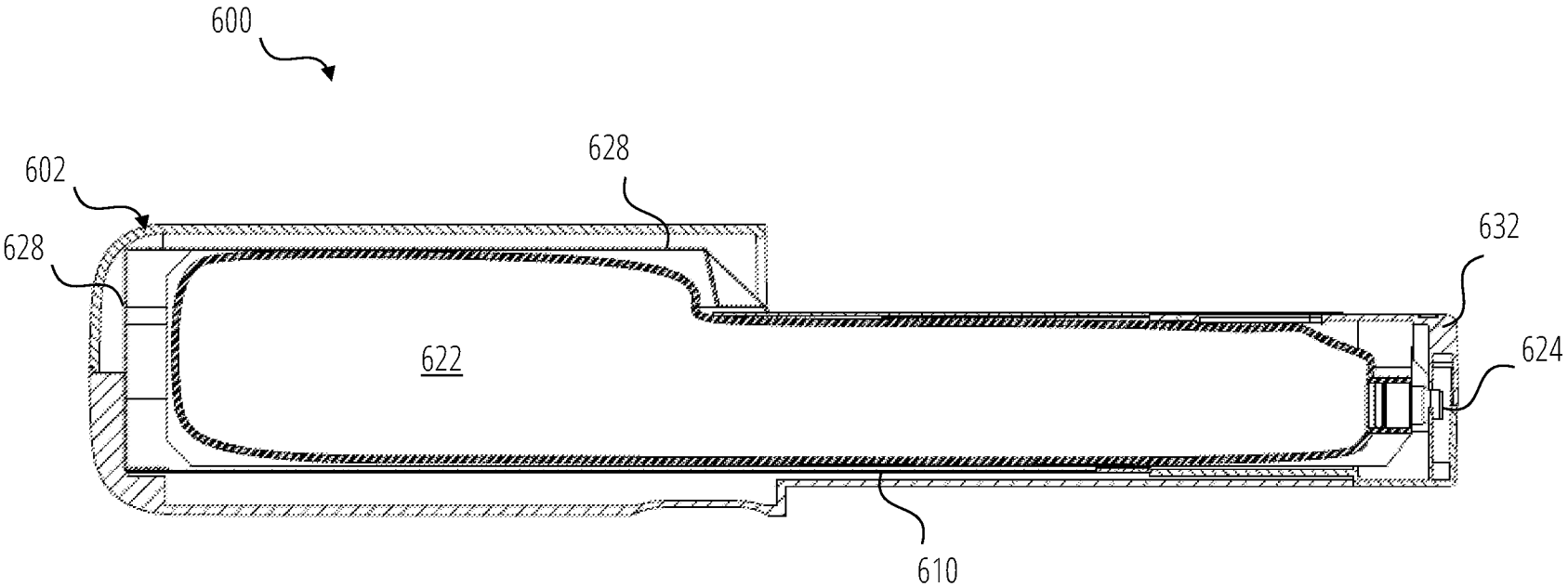
FIG. 6D shows a side section view of the formulation cartridge of FIG. 6A.

As shown in FIG. 6C, each formulation packet includes a formulation-containing packet 622 and a valve 624 through which the formulation exits the packet 622. Representative formulation packets are described in International Patent Application No. PCT/US2018/052345, filed Sep. 24, 2018 and assigned to L'Oreal SA, and U.S. patent application Ser. No. 17/133,110, filed Dec. 23, 2020 and assigned to L'Oreal SA, both of which are hereby incorporated by reference in their entireties for all purposes.

Disposable refill packet 604 also includes a disposable elongate body portion 626 which provides structure to the disposable refill packet 604 and contains the first formulation packet 614 and second formulation packet 616. In some embodiments, body portion 626 has a total length between 150 mm and 250 mm (e.g., 175 mm-225 mm, 185 mm-215 mm, 195 mm-205 mm, or 200 mm) and a maximum cross sectional dimension of 25 mm-50 mm (e.g., 30 mm-45 mm, 35 mm-40 mm, or 36 mm). Body portion 626 has a rear body portion 628 and a slender front body portion 610. The rear body portion 628 has a larger cross sectional dimension than the front body portion 610 and remains inside the handle portion 602 of the handle portion 602 (e.g., by friction fit) during use. The slender front body portion 610 is supported by the tray portion 606 of the handle portion 602, and projects into the cartridge cavity of the formulation delivery device during use.

In the illustrated embodiment, body portion 626 is constructed from a recyclable material, e.g., structured paper (e.g., cardboard). In some embodiments in which the body portion 626 is formed of paper, the paper has a weight between 8-12 points (e.g., 8.5 points, 9.0 points, 9.5 points, 10.0 points, 10.5 points, 11.0 points, or 11.5 points), to impart sufficient stiffness without contributing excess disposable material. In some such embodiments, the body portion 626 is formed of a single piece of the recyclable material. As one example, in the illustrated embodiment, the body portion 626 is formed of a single piece of paper. As shown in FIG. 6C, this folded construction creates an eight-sided polygonal cross section in the rear body portion 628 and a six-sided polygonal cross section in the front body portion 610. To facilitate assembly, some embodiments of the body portion 626 include one or more scores or guidelines that ensure correct folding. The polygonal cross section of the illustrated embodiment is representative, not limiting. Other embodiments have a triangular, rectangular, pentagonal, hexagonal, heptagonal, octagonal, or other polygonal cross sectional shape. In other embodiments, body portion 626 has the shape and structure described herein, but it not constructed from a recyclable material.

Optional packet sleeve 630 provides a number of important advantages. First, it imparts additional structure to the disposable refill packet 604 by sliding over and reinforcing front body portion 610. Accordingly, in some embodiments, packet sleeve 630 has a greater weight or thickness as compared to the material that forms body portion 626; although this is not required. In some embodiments, packet sleeve 630 is also formed of a recyclable material, which may be the same recyclable material as the body portion 626.

Second, packet sleeve 630 couples with the valve frame 632. For example, the illustrated packet sleeve 630 includes a plurality of engagement member recesses 634 configured to reversibly couple with engagement members of the valve frame 632.

Third, packet sleeve 630 facilitates disassembly of the disposable refill packet 604. As shown in FIG. 6A and FIG. 6C, packet sleeve 630 includes an optional integral tearaway 636 (e.g., a perforation with a pull tab). In use, after the formulation is depleted, a user pulls the pull tab of integral tearaway 636, thereby separating valve frame 632 from packet sleeve 630. Upon completion of this action, the packet sleeve 630 is recycled and the valve frame 632 is discarded. In some embodiments, the integral tearaway 636 is disposed on the body portion 626, e.g., the front body portion 610.

Although packet sleeve 630 imparts a number of advantages, it is optional. In some embodiments, one or more of the above features of the packet sleeve 630 are integrally formed in the body portion 626.

Valve frame 632 provides a rigid structure which supports the formulation packet valves 624 and an encryption chip 638 for accurate and solid coupling with the formulation delivery device (and in particular, with the formulation dispensing assembly thereof), and for accurate positioning of the encryption chip 638 adjacent to the cartridge interrogation interface of the formulation delivery device. Accordingly, valve frame 632 is formed from ABS plastic, HDPE, or other rigid polymer or other material. A plurality of valve apertures 640 extend through a front end of the valve frame 632. Each valve aperture 640 receives and secures one of the formulation packet valves 624. To enable coupling with the packet sleeve 630 (or body portion 626 in some embodiments), valve frame 632 includes engagement members 642 (e.g., tabs) extending therefrom.

Encryption chip 638 is disposed on the disposable refill packet 604, e.g., on the body portion 626 or on the valve frame 632 (as in the illustrated embodiment). The encryption chip 638 is positioned on the disposable refill packet 604 such that when the formulation cartridge 600 is inserted into the formulation delivery device, it is positioned to be read by the cartridge interrogation interface thereof. Accordingly, the encryption chip 638 stores information about the formulation cartridge 600 and its contents, for example at least one of an identifier of the formulation cartridge 600, a formulation identification, a beginning formulation quantity, a formulation expiration date, or a formulation production date.

Thus, the body portion 626, packet sleeve 630, formulation packets, and valve frame 632 form the disposable refill packet 604. In use, disposable refill packet 604 is reversibly couplable with handle portion 602, e.g., by friction fit and/or by a plurality of optional coupling tabs 644 on the body portion 626 or packet sleeve 630. The coupling tabs 644 engage the handle portion 602 upon insertion of the disposable refill packet 604 therein, and retains the same therein until forcefully pulled out of the handle portion 602. To further aid retention of the disposable refill packet 604 within handle portion 602, the illustrated handle portion 602 includes one or more optional retention elements 646 (in this embodiment, a deflectable tab that engages the disposable refill packet 604).

Figure 7:
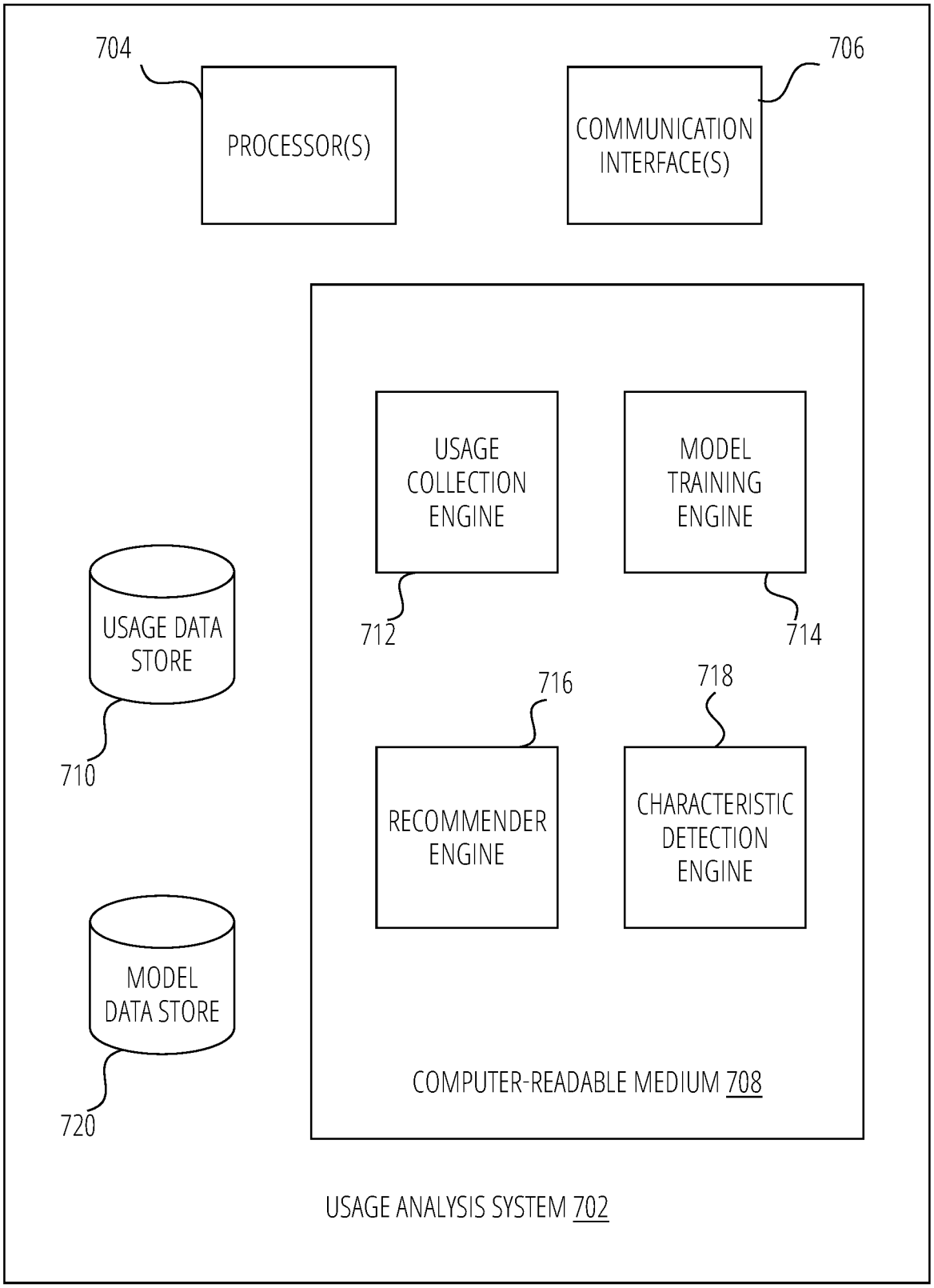
FIG. 7 is a block diagram that illustrates aspects of a non-limiting example embodiment of a usage analysis system according to various aspects of the present disclosure.

FIG. 7 is a block diagram that illustrates aspects of a non-limiting example embodiment of a usage analysis system according to various aspects of the present disclosure. The illustrated usage analysis system 702 may be implemented by any computing device or collection of computing devices, including but not limited to a desktop computing device, a laptop computing device, a mobile computing device, a server computing device, a computing device of a cloud computing system, and/or combinations thereof. In some embodiments, at least some components of the usage analysis system 702 may be provided by the mobile device 302 or other elements of the platform 300 described above. In some embodiments, the usage analysis system 702 is configured to receive signals generated by the formulation delivery device 104 to automatically determine one or more hair characteristics for a subject. In some embodiments, the usage analysis system 702 may correlate hair characteristics with applied formulation products, and may use the correlations to determine recommendations for formulation products based on detected hair characteristics.

As shown, the usage analysis system 702 includes one or more processors 704, one or more communication interfaces 706, a usage data store 710, a model data store 720, and a computer-readable medium 708.

As used herein, "data store" refers to any suitable device configured to store data for access by a computing device. One example of a data store is a highly reliable, high-speed relational database management system (DBMS) executing on one or more computing devices and accessible over a high-speed network. Another example of a data store is a key-value store. However, any other suitable storage technique and/or device capable of quickly and reliably providing the stored data in response to queries may be used, and the computing device may be accessible locally instead of over a network, or may be provided as a cloud-based service. A data store may also include data stored in an organized manner on a computer-readable storage medium, such as a hard disk drive, a flash memory, RAM, ROM, or any other type of computer-readable storage medium. One of ordinary skill in the art will recognize that separate data stores described herein may be combined into a single data store, and/or a single data store described herein may be separated into multiple data stores, without departing from the scope of the present disclosure.

In some embodiments, the processors 704 may include any suitable type of general-purpose computer processor. In some embodiments, the processors 704 may include one or more special-purpose computer processors or AI accelerators optimized for specific computing tasks, including but not limited to graphical processing units (GPUs), vision processing units (VPTs), and tensor processing units (TPUs).

In some embodiments, the communication interfaces 706 include one or more hardware and or software interfaces suitable for providing communication links between components. The communication interfaces 706 may support one or more wired communication technologies (including but not limited to Ethernet, FireWire, and USB), one or more wireless communication technologies (including but not limited to Wi-Fi, WiMAX, Bluetooth, 2G, 3G, 4G, 5G, and LTE), and/or combinations thereof.

As shown, the computer-readable medium 708 has stored thereon logic that, in response to execution by the one or more processors 704, cause the usage analysis system 702 to provide a usage collection engine 712, a model training engine 714, a recommender engine 716, and a characteristic detection engine 718.

In some embodiments, the usage collection engine 712 is configured to receive signals indicative of usage of the formulation delivery system 100, including but not limited to signals generated by the formulation delivery device 104, and to store the signals in the usage data store 710. In some embodiments, the model training engine 714 is configured to train one or more machine learning models based on usage information, including but not limited to at least one of a machine learning model trained to detect hair characteristics and a recommender model, and to store the trained models in the model data store 720. In some embodiments, the recommender engine 716 is configured to use the recommender model from the model data store 720 to recommend formulation products. In some embodiments, the characteristic detection engine 718 is configured to derive hair characteristics from a subject based on signals generated by the formulation delivery device 104, and may use a machine learning model from the model data store 720 to do so.

Further description of the configuration of each of these components is provided below.

Figure 8A:
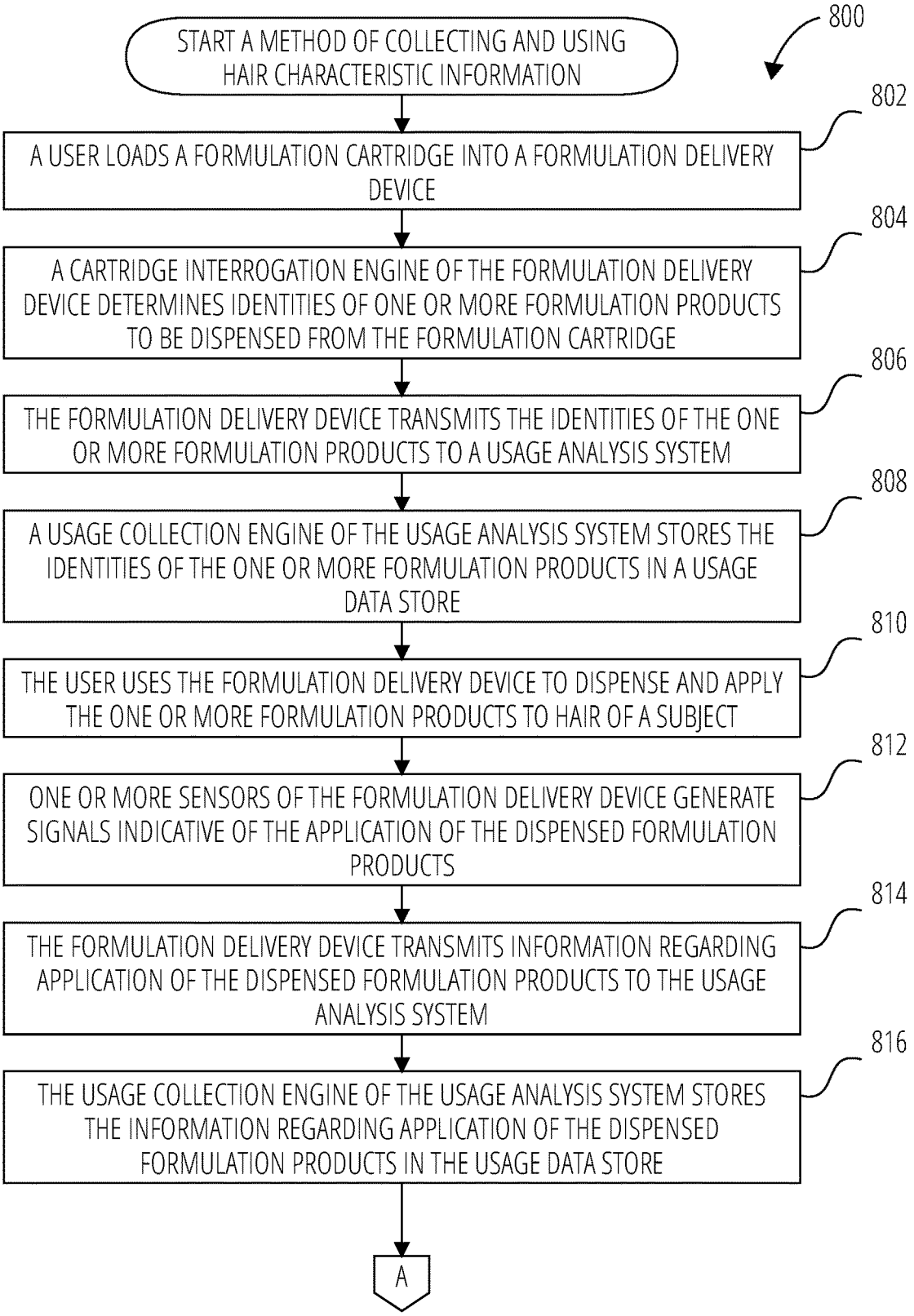
FIG. 8A-FIG. 8B are a flowchart that illustrates a non-limiting example embodiment of a method of collecting and using hair characteristic information according to various aspects of the present disclosure.
Figure 8B:
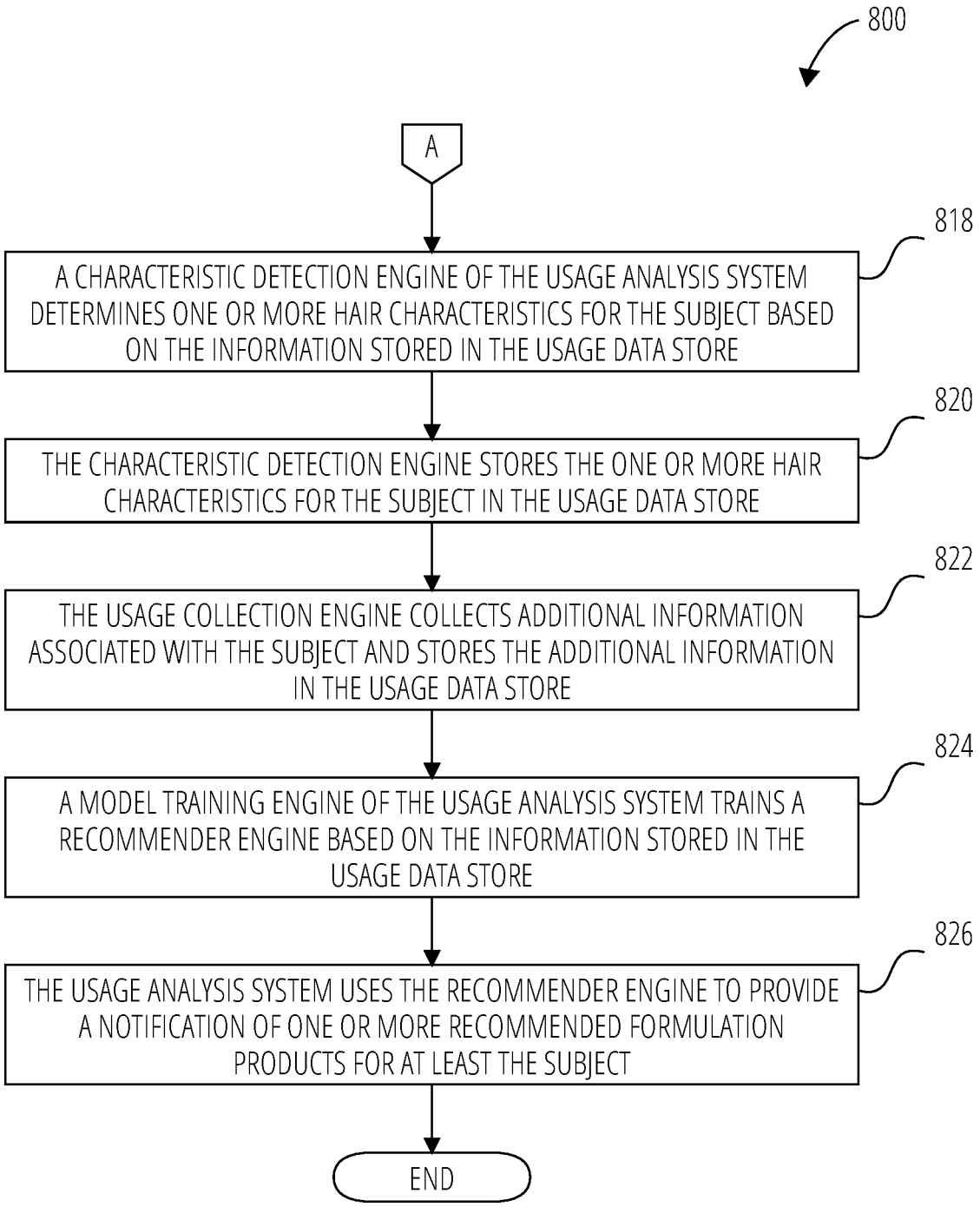

FIG. 8A-FIG. 8B is a flowchart that illustrates a non-limiting example embodiment of a method of collecting and using hair characteristic information according to various aspects of the present disclosure. In the method 800, a usage analysis system 702 receives signals generated by a formulation delivery device 104 and uses the signals to automatically determine one or more hair characteristics for a subject. The automatically determined hair characteristics are combined with information regarding the formulation products applied to the hair of the subject and stored in the usage data store 710. The stored information in the usage data store 710 is then used to train a recommender engine 716 to provide recommendations for formulation products for the subject and for others.

By automatically detecting hair characteristic information, the subject is relieved of the need to manually input this information, which the subject may not even be knowledgeable enough to accurately provide. Further, automatically detected hair characteristic information may be more precise than manually collected hair characteristic information. As a non-limiting example, techniques discussed below may distinguish different curl tightnesses as different types of hair, while manually collected hair characteristic information may simply describe different types of curly hair as "curly." Likewise, collecting information automatically (including the hair characteristic information and the identification of formulation products) eliminates errors that may be introduced by misidentification of formulation products or hair characteristics via manual entry. Using this higher precision and more reliable information leads the recommender engine 716 being trained to provide more useful and effective recommendations, thus improving the functioning of the system.

From a start block, the method 800 proceeds to block 802, where a user loads a formulation cartridge 108 into a formulation delivery device 104. As discussed above, loading the formulation cartridge 108 into the formulation delivery device 104 brings the encryption chip 432 of the formulation cartridge 108 into range of the cartridge interrogation interface 210.

At block 804, a cartridge interrogation engine 230 of the formulation delivery device 104 determines identities of one or more formulation products to be dispensed from the formulation cartridge 108. In some embodiments, the cartridge interrogation engine 230 uses the cartridge interrogation interface 210 to read the identities of the one or more formulation products from the encryption chip 432. In some embodiments, the cartridge interrogation engine 230 may obtain a unique identifier from the encryption chip 432, and may either query a data store for the identities of the one or more formulation products based on the unique identifier, or may provide the unique identifier as the identity of the one or more formulation products and an upstream component may query the data store using the unique identifier to determine the actual one or more formulation products.

At block 806, the formulation delivery device 104 transmits the identities of the one or more formulation products to a usage analysis system 702. In some embodiments, the formulation delivery device 104 communicates the identities of the one or more formulation products to the mobile device 302, which in turn transmits the formulation products to the usage analysis system 702 (or includes components of the usage analysis system 702).

At block 808, a usage collection engine 712 of the usage analysis system 702 stores the identities of the one or more formulation products in a usage data store 710. In some embodiments, the usage collection engine 712 may create a record in the usage data store 710 that associates an identity of a subject (e.g., a user account, a login, an email address, a phone number, etc.) to whom the one or more formulation products are to be applied with the one or more formulation products.

At block 810, the user uses the formulation delivery device 104 to dispense and apply the one or more formulation products to hair of a subject. In some embodiments, the user may be the same person as the subject, such as in embodiments where the user is using the formulation delivery device 104 to apply the one or more formulation products to their own hair. In some embodiments, the user and the subject may be different persons, such as in embodiments where the user is a stylist using the formulation delivery device 104 to apply the one or more formulation products to a client/subject. In dispensing and applying the one or more formulation products, the motor 218 drives the reciprocating nozzle assembly 222, and the one or more formulation products are dispensed from the plurality of annular nozzles 518 of the reciprocating nozzle assembly 222.

At block 812, one or more sensors of the formulation delivery device 104 generate signals indicative of the application of the dispensed formulation products. In some embodiments, multiple different signals may be generated by different sensors of the formulation delivery device 104.

One non-limiting example embodiment of a signal indicative of the application of the dispensed formulation products is a signal generated by the position engine 238 based on positions of the platform 106 sensed by the position sensor 216. In some embodiments, such a signal may be raw signals generated by the position sensor 216, while in other embodiments, such a signal may be a three-dimensional indication of a position and orientation of the formulation delivery device 104 over time during application. Depending on various hair characteristics, including but not limited to thickness and curl type, the path that the user guides the formulation delivery device 104 through while dispensing the formulation products may be usable to determine the hair characteristics. For example, combing through tighter curls may lead to a less-smooth motion through the hair than combing through straight hair. As another example, instructions to use different brushing patterns (e.g., straight patterns for straight hair, zig-zag patterns for curly hair) may be provided to the user, and so the motion of these different brushing patterns may be detected using the position information and correlated to the hair characteristics.

Another non-limiting example embodiment of a signal indicative of the application of the dispensed formulation products is a signal generated by the power management engine 234 based on power consumption of the motor 218. Depending on various hair characteristics, including but not limited to thickness, roughness, and curl type, different amounts of power may be consumed by the motor 218 due to different amounts of physical resistance provided by hair having different characteristics, or the power consumed by the motor 218 may vary more or less depending on the hair characteristic (e.g., a standard deviation of power consumption may be greater for curly hair and smaller for straight hair). Accordingly, the signal based on power consumption of the motor 218 may be usable to determine the hair characteristics as described in further detail below.

Yet another non-limiting example embodiment of a signal indicative of the application of the dispensed formulation products is an audio signal generated by a microphone mounted on the formulation delivery device 104, the mobile device 302, or another suitable device. Depending on various hair characteristics, a sound generated by moving the comb 520 of the formulation delivery device 104 through the hair of the subject may be different. Accordingly, the audio signal may be usable to determine one or more hair characteristics.

At block 814, the formulation delivery device 104 transmits information regarding application of the dispensed formulation products to the usage analysis system 702. In some embodiments, the information regarding application of the dispensed formulation products may be the unprocessed signals indicative of the application of the dispensed formulation products. In some embodiments, the information regarding application of the dispensed formulation products may be processed information (e.g., three-dimensional position information derived from the signals generated by the position sensor 216).

At block 816, the usage collection engine 712 of the usage analysis system 702 stores the information regarding application of the dispensed formulation products in the usage data store 710. In some embodiments, the information regarding application of the dispensed formulation products is stored in (or is associated with) the record of the usage created at block 808.

The method 800 then proceeds to a continuation terminal ("terminal A"). From terminal A (FIG. 8B), the method 800 proceeds to block 818, where a characteristic detection engine 718 of the usage analysis system 702 determines one or more hair characteristics for the subject based on the information stored in the usage data store 710. In some embodiments, the characteristic detection engine 718 automatically determines the one or more hair characteristics based on the information regarding application of the dispensed formulation products transmitted at block 814 and stored in the usage data store 710 at block 816.

Any suitable technique may be used to determine the hair characteristics based on the information regarding application of the dispensed formulation products ("application information"). In some embodiments, ranges for a type of application information that are correlated to specific hair characteristics may be established, and the application information may be compared to the ranges. As a non-limiting example, it may be empirically determined that power consumption for curly hair varies within a first range, and that power consumption for straight hair varies within a second range. Accordingly, the power consumption reported by the formulation delivery device 104 may be compared to these ranges, and the hair characteristic (e.g., straight or curly hair) may be determined based on which range the reported power consumption falls into. As another non-limiting example, it may be empirically determined that the volume of an audio signal detected by a microphone is within a first range for straight hair and within a second range for curly hair, and the volume of the audio signal reported by the formulation delivery device 104 may be compared to these ranges to determine the hair characteristic. In some embodiments, heuristics other than ranges may be used to associate types of application information with hair characteristics, including but not limited to maximum values, minimum values, a difference between a maximum and minimum value, average values, standard deviations, and entropy.

In some embodiments, one or more machine learning models may be used to process the application information in order to detect hair characteristics. For example, power consumption information or position information may be provided as input to a machine learning model, and the machine learning model may provide an output that classifies a type for a given hair characteristic (e.g., curly vs. straight; rough vs. smooth; thick vs. thin). Any suitable technique may be used to train such a machine learning model, including but not limited to collecting ground truth labeled training data from subjects having known hair characteristics, and using gradient descent, an Adam optimizer, or any other suitable technique to training the machine learning model using the ground truth labeled training data. Further, any suitable type of machine learning model may be used, including but not limited to decision trees, naive Bayes classifiers, artificial neural networks, artificial recurrent neural networks (including but not limited to long short-term memory (LSTM) networks), and convolutional neural networks.

The discussion above simplifies a hair characteristic as being straight hair vs curly hair for ease of discussion. In some embodiments, a hair characteristic may be a specific curl type and amount of curl from the Andre Walker Hair Typing System (i.e., Type 1A-C (straight), Type 2A-C (wavy), Type 3A-C (curly), or Type 4A-C (coily)), the L.O.I.S. Hair Typing System, the NaturallyCurly Hair Typing System, or any other hair typing system. In some embodiments, other hair characteristics may be automatically detected, including but not limited to coarseness, density, thickness, length, texture, scalp condition, and amounts of damage.

The discussion above also assumes that the hair characteristics fall into established/recognizable categories. In some embodiments, machine learning may be used to cluster hair characteristics into categories that are not necessarily correlated into established/recognizable categories. For example, a clustering analysis of the application information may determine arbitrary categories for hair characteristics (e.g., Type A hair, Type B hair, Type C hair) wherein the application information indicates that the subjects have similar hair, even if traditional hair characteristics such as curl type, moisture content, and so on do not necessarily match.

At block 820, the characteristic detection engine 718 stores the one or more hair characteristics for the subject in the usage data store 710. In some embodiments, the characteristic detection engine 718 may associate the one or more hair characteristics with the identity of the subject. In some embodiments, the characteristic detection engine 718 may also associate the one or more hair characteristics with the information regarding application of the dispensed formulation products.

At block 822, the usage collection engine 712 collects additional information associated with the subject and stores the additional information in the usage data store 710. The additional information may be associated in the usage data store 710 with the identity of the subject, with the information regarding application of the dispensed formulation products, or both. In some embodiments, the additional information may include rating information provided by the subject or the user for the formulation products that were applied.

In some embodiments, the additional information may include hair characteristics that could not be automatically determined from the application information, including but not limited to color, moisture content, damage, or style. In some embodiments, this additional information may be collected via questionnaire responses entered by the user, or may be collected automatically from an image captured of the subject or the hair of the subject. In some embodiments, this additional information may be collected by a sensor, such as hair moisture information collected by a moisture sensor. In some embodiments, the additional information may include environmental information regarding the environment the hair is or will be exposed to, including but not limited to a humidity level, an amount of sun exposure, and an environmental temperature. This environmental information may be collected in any suitable way, including but not limited to querying a data store that includes environmental information for a location of the subject, using a sensor that directly measures the environmental information, and/or receiving the environmental information via a questionnaire.

At block 824, a model training engine 714 of the usage analysis system 702 trains a recommender engine 716 based on the information stored in the usage data store 710. In some embodiments, the recommender engine 716 itself may be trained by the model training engine 714, while in other embodiments, a recommender model may be trained by the model training engine 714, stored in the model data store 720, and retrieved/used by the recommender engine 716 when appropriate. Any technique may be used to implement the recommender model and/or recommender engine 716, including but not limited to collaborative filtering techniques, content-based filtering techniques, and hybrid techniques. Further, any suitable technique for training may be used, including identifying groups of subjects based on similarities in provided ratings or hair characteristics.

At block 826, the usage analysis system 702 uses the recommender engine 716 to provide a notification of one or more recommended formulation products for at least the subject. In some embodiments, the usage analysis system 702 may process information in the usage data store 710 (including but not limited to the hair characteristics for the subjects) through the recommender engine 716 to determine recommended products for subjects that perhaps the subjects have not previously used, and may transmit the notifications of the recommended products to the subjects via email, text messages, social media messages, targeted advertising, in-app notifications, or via any other suitable technique. In some embodiments, the actions of block 826 may be performed at a predetermined rate (e.g., once per day, once per week, etc.). In some embodiments, the actions of block 826 may be performed for a given subject once information for the subject is stored in the usage data store 710.

In some embodiments, other types of recommendations other than product recommendations may be provided by the recommender engine 716. For example, in some embodiments, the formulation routine engine 226 operates the formulation dispensing assembly 214 according to a formulation routine, and the recommender engine 716 may provide a new formulation routine as a recommendation that changes parameters of the formulation routine such as a routine length, a liquid flow rate of the pump 220, a reciprocating frequency or amplitude of the reciprocating nozzle assembly 222, or other device operating parameters. As another example, in some embodiments the recommendation may take the form of coaching to be provided to the user. As yet another example, in some embodiments the recommendation may include ingredients for customized formulation products to be compounded for the subject.

As illustrated, the method 800 then proceeds to an end block and terminates. In some embodiments, the method 800 (Or portions thereof) may be repeated instead of advancing to the end block. For example, the usage analysis system 702 may use the recommender engine 716 to provide notifications of one or more recommended formulation products multiple times for the subject, for individuals other than the subject, or for both the subject and others. As another example, the usage analysis system 702 may collect usage information associated with multiple subjects prior to training the recommender engine 716, or may retrain the recommender engine 716 after collecting usage information associated with additional subjects.

Much of the description of method 800 assumes that a single value for a given hair characteristic (e.g., curly hair, thin hair) would be determined for a given subject for the sake of clarity. In some embodiments, multiple values for a given hair characteristic may be determined for a given subject. For example, a first curl type may be determined in a first region and a second curl type may be determined in a second region. In some embodiments, the presence of each value for the hair characteristic may simply be detected and noted, while in other embodiments, position information obtained from the position sensor 216 may be used to assign a region of the hair or head to be associated with each detected value of the hair characteristic.

The present application may also reference quantities and numbers. Unless specifically stated, such quantities and numbers are not to be considered restrictive, but representative of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

Embodiments disclosed herein may utilize circuitry in order to implement technologies and methodologies described herein, operatively connect two or more components, generate information, determine operation conditions, control an appliance, device, or method, and/or the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof.

In an embodiment, circuitry includes one or more ASICs having a plurality of predefined logic components. In an embodiment, circuitry includes one or more FPGA having a plurality of programmable logic components. In an embodiment, circuitry includes hardware circuit implementations (e.g., implementations in analog circuitry, implementations in digital circuitry, and the like, and combinations thereof). In an embodiment, circuitry includes combinations of circuits and computer program products having software or firmware instructions stored on one or more computer readable memories that work together to cause a device to perform one or more methodologies or technologies described herein. In an embodiment, circuitry includes circuits, such as, for example, microprocessors or portions of microprocessor, that require software, firmware, and the like for operation. In an embodiment, circuitry includes an implementation comprising one or more processors or portions thereof and accompanying software, firmware, hardware, and the like. In an embodiment, circuitry includes a baseband integrated circuit or applications processor integrated circuit or a similar integrated circuit in a server, a cellular network device, other network device, or other computing device. In an embodiment, circuitry includes one or more remotely located components. In an embodiment, remotely located components are operatively connected via wireless communication. In an embodiment, remotely located components are operatively connected via one or more receivers, transmitters, transceivers, or the like.

In an embodiment, circuitry includes one or more computer-readable media drives, interface sockets, Universal Serial Bus (USB) ports, memory card slots, or the like, and one or more input/output components such as, for example, a graphical user interface, a display, a keyboard, a keypad, a trackball, a joystick, a touch-screen, a mouse, a switch, a dial, or the like, and any other peripheral device. In an embodiment, circuitry includes one or more user input/output components that are operatively connected to at least one computing device to control (electrical, electromechanical, software-implemented, firmware-implemented, or other control, or combinations thereof) one or more aspects of the embodiment.

In an embodiment, circuitry includes a computer-readable media drive or memory slot configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as any form of flash memory, magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of example embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

What is claimed is:

1. A computer-implemented method of automatically determining at least one hair characteristic for a subject, the method comprising:

receiving, by a computing system, signals from a formulation delivery device indicative of application of one or more dispensed formulation products, wherein the signals indicate power consumed by a motor of the formulation delivery device while operating a reciprocating nozzle assembly of the formulation delivery device;

analyzing, by the computing system, the signals to automatically determine the at least one hair characteristic; and storing, by the computing system, the at least one hair characteristic in a usage data store.

2. The computer-implemented method of claim 1, wherein analyzing the signals to automatically determine the at least one hair characteristic includes providing the signals as input to at least one machine learning model.

3. The computer-implemented method of claim 1, wherein analyzing the signals to automatically determine the at least one hair characteristic includes comparing the signals to one or more ranges associated with hair characteristic values.

4. The computer-implemented method of claim 1, further comprising receiving, by the computing system, additional information associated with the subject, wherein the additional information includes at least one of a moisture level and a color.

5. The computer-implemented method of claim 1, wherein the at least one hair characteristic includes at least one of:

a curl type;
a coarseness;
a density;
a thickness;
a length;
a texture;
a scalp condition; and
an amount of damage.

6. The computer-implemented method of claim 1, further comprising using at least the hair characteristics stored in the usage data store to train a recommender engine.

7. The computer-implemented method of claim 1, further comprising:

providing, by the computing system, the at least one hair characteristic as input to a recommender engine to generate a recommendation; and providing, by the computing system, a notification of the recommendation to the subject.

8. A system for automatically determining at least one hair characteristic for a subject, the system comprising:

circuitry configured to receive signals from a formulation delivery device indicative of application of one or more dispensed formulation products, wherein the signals indicate power consumed by a motor of the formulation delivery device while operating a reciprocating nozzle assembly of the formulation delivery device;

circuitry configured to analyze the signals to automatically determine the at least one hair characteristic; and circuitry configured to store the at least one hair characteristic in a usage data store.

9. The system of claim 8, wherein analyzing the signals to automatically determine the at least one hair characteristic includes providing the signals as input to at least one machine learning model.

10. The system of claim 8, wherein analyzing the signals to automatically determine the at least one hair characteristic includes comparing the signals to one or more ranges associated with hair characteristic values.

11. The system of claim 8, further comprising circuitry configured to receive additional information associated with the subject, wherein the additional information includes at least one of a moisture level and a color.

12. The system of claim 8, wherein the at least one hair characteristic includes at least one of:

a curl type;

a coarseness;

a density;

a thickness;

a length;

a texture;

a scalp condition; and an amount of damage.

13. The system of claim 8, further comprising:

circuitry configured to provide the at least one hair characteristic as input to a recommender engine to generate a recommendation; and circuitry configured to provide a notification of the recommendation to the subject.

14. A system, comprising:

a formulation delivery device; and a usage analysis system;

wherein the formulation delivery device includes:

a motor;

a formulation dispensing assembly comprising a reciprocating nozzle assembly operated by the motor;

circuitry configured to generate signals indicative of application of one or more formulation products dispensed by the formulation dispensing assembly; and circuitry configured to transmit the signals indicative of the application of the formulation products to a usage analysis system; and wherein the usage analysis system includes:

one or more processors; and a non-transitory computer-readable medium having computer-executable instructions stored thereon that, in response to execution by the one or more processors, cause the usage analysis system to perform actions comprising:

receiving, by the usage analysis system, the signals from the formulation delivery device indicative of the application of one or more formulation products, wherein the signals indicate power consumed by the motor of the formulation delivery device while operating the reciprocating nozzle assembly of the formulation delivery device;

analyzing, by the usage analysis system, the signals to automatically determine the at least one hair characteristic; and storing, by the usage analysis system, the at least one hair characteristic in a usage data store.

15. The system of claim 14, wherein the formulation delivery device further includes a position sensor; and wherein the signals indicative of the application of the formulation products dispensed by the formulation dispensing assembly include signals indicating a position of the formulation delivery device as detected by the position sensor.

16. The system of claim 14, wherein the formulation delivery device further includes:

a cartridge interrogation interface configured to retrieve information from a formulation cartridge inserted into the formulation delivery device; and circuitry configured to transmit the information retrieved from the formulation cartridge to the usage analysis system.

17. The system of claim 14, wherein the formulation delivery device further includes:

circuitry for operating the motor to dispense a formulation product according to a formulation routine;

circuitry configured to receive, from the usage analysis system, a new formulation routine based on a hair characteristic determined using the signals indicative of the application of the formulation products.

* * * * *